US009732597B2

(12) United States Patent
Luke et al.

(10) Patent No.: US 9,732,597 B2
(45) Date of Patent: Aug. 15, 2017

(54) TELEMETRY OPERATED EXPANDABLE LINER SYSTEM

(71) Applicant: Weatherford Technology Holdings, LLC, Houston, TX (US)

(72) Inventors: Mike A. Luke, Houston, TX (US); Karsten Heidecke, Houston, TX (US); Scott McIntire, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 489 days.

(21) Appl. No.: 14/447,288

(22) Filed: Jul. 30, 2014

(65) Prior Publication Data

US 2016/0032695 A1 Feb. 4, 2016

(51) Int. Cl.

| | |
|---|---|
| ***E21B 34/06*** | (2006.01) |
| ***E21B 43/10*** | (2006.01) |
| ***E21B 47/12*** | (2012.01) |

(52) U.S. Cl.

CPC ..... *E21B 43/103* (2013.01); *E21B 34/066* (2013.01); *E21B 43/105* (2013.01); *E21B 43/108* (2013.01); *E21B 47/12* (2013.01)

(58) Field of Classification Search

CPC .... E21B 43/105; E21B 43/108; E21B 34/066; E21B 43/103; E21B 47/12; E21B 23/00; E21B 23/01; E21B 43/10

See application file for complete search history.

(56) References Cited

U.S. PATENT DOCUMENTS

| | | | | |
|---|---|---|---|---|
| 5,360,069 | A | 11/1994 | Schmuck et al. | |
| 6,012,523 | A | 1/2000 | Campbell et al. | |
| 7,063,148 | B2 | 6/2006 | Jabusch | |
| 7,121,351 | B2 | 10/2006 | Luke et al. | |
| 7,766,088 | B2 | 8/2010 | Saucier et al. | |
| 8,069,916 | B2 * | 12/2011 | Giroux | E21B 7/20 166/212 |

(Continued)

FOREIGN PATENT DOCUMENTS

EP 1942248 A1 7/2008

OTHER PUBLICATIONS

EPO Extended European Search Report dated Nov. 10, 2015, for EPO Patent Application No. 15177990.7.

(Continued)

*Primary Examiner* — Daniel P Stephenson

(74) *Attorney, Agent, or Firm* — Patterson & Sheridan, LLP

(57) ABSTRACT

A deployment assembly for expanding a liner string in a wellbore includes: a tubular mandrel having a bore therethrough; an expander linked to the mandrel and operable between an extended position and a retracted position; an extension tool disposed along the mandrel and operable to extend the expander; and a retraction tool disposed along the mandrel. The retraction tool has: an upper piston in fluid communication with the mandrel bore and operable to retract the expander; a lower piston in fluid communication with the mandrel bore and operable to balance the upper piston; a valve disposed between the pistons for isolating the lower piston from the upper piston in a closed position; and an electronics package linked to the valve for opening and closing the valve in response to receiving a command signal.

22 Claims, 14 Drawing Sheets

(56) References Cited

U.S. PATENT DOCUMENTS

| | | | | |
|---|---|---|---|---|
| 8,286,717 | B2 | 10/2012 | Giroux et al. | |
| 8,783,343 | B2 | 7/2014 | Giroux et al. | |
| 8,875,783 | B2 * | 11/2014 | Giroux | E21B 43/105 166/207 |
| 2005/0161213 | A1 * | 7/2005 | Sonnier | E21B 29/10 166/207 |
| 2006/0065408 | A1 | 3/2006 | Green et al. | |
| 2006/0124295 | A1 * | 6/2006 | Maguire | E21B 43/103 166/207 |
| 2009/0272544 | A1 | 11/2009 | Giroux et al. | |
| 2012/0055683 | A1 | 3/2012 | Giroux et al. | |
| 2012/0090858 | A1 | 4/2012 | Ingram et al. | |
| 2013/0228344 | A1 | 9/2013 | Luke | |
| 2013/0233548 | A1 | 9/2013 | Santeler et al. | |
| 2014/0196912 | A1 | 7/2014 | Turley et al. | |
| 2014/0202768 | A1 | 7/2014 | Noske | |
| 2014/0305662 | A1 | 10/2014 | Giroux et al. | |
| 2015/0136393 | A1 * | 5/2015 | Turley | E21B 43/10 166/285 |
| 2016/0032695 | A1 * | 2/2016 | Luke | E21B 34/066 166/285 |

OTHER PUBLICATIONS

MetalSkin Monobore Open-Hole Liner System Brochure, Weatherford, 2011.

Australian Patent Examination Report dated May 9, 2016, for Australian Patent Application No. 2015205979.

* cited by examiner

TELEMETRY OPERATED EXPANDABLE LINER SYSTEM

BACKGROUND OF THE DISCLOSURE

Field of the Disclosure

The present disclosure generally relates to a telemetry operated expandable liner system.

Description of the Related Art

A wellbore is formed to access hydrocarbon-bearing formations by the use of drilling. Drilling is accomplished by utilizing a drill bit that is mounted on the end of a drill string. To drill within the wellbore to a predetermined depth, the drill string is often rotated by a top drive or rotary table on a surface platform or rig or by a downhole motor mounted towards the lower end of the drill string. After drilling a first section of the wellbore to a first depth, the drill string and drill bit are removed and a section of casing is lowered into the wellbore. The casing string is hung from the wellhead. A cementing operation is then conducted in order to fill an annulus between the casing string and the wellbore. The combination of cement and casing strengthens the wellbore and facilitates the isolation of certain areas of the formation behind the casing for the production of hydrocarbons.

It is common to employ more than one string of casing or liner in a wellbore. After cementing of the casing string, a second section of the wellbore is drilled to a second depth, and a second string of casing or liner, is run into the drilled out portion of the wellbore. If the second string is liner, the liner string is hung from a lower portion of the casing string and cemented into place. If the second string is casing, the second string is hung from the wellhead and cemented into place. This process is typically repeated with additional strings until the wellbore has been drilled to total depth. As more casing or liner strings are set in the wellbore, the casing or liner strings become progressively smaller in diameter in order to fit within the previous casing or liner string.

Decreasing the diameter of the well produces undesirable consequences, such as limiting the size of wellbore tools which are capable of being run into the wellbore and/or limiting the volume of hydrocarbon production fluids which may flow to the surface from the formation. In order to mitigate issues caused by an undesirable decrease in diameter, the second section of the wellbore may be drilled and reamed to the same diameter of the first section and then an expandable liner string may be run in, cemented, and expanded into the second wellbore section. The liner string may be expanded by driving a cone therethrough. Once expansion of the liner string is complete, it is necessary to retrieve the cone from the wellbore. Retrieval of the cone through the first casing string may cause damage thereto.

SUMMARY OF THE DISCLOSURE

The present disclosure generally relates to a telemetry operated expandable liner system. In one embodiment, a deployment assembly for expanding a liner string in a wellbore includes: a tubular mandrel having a bore therethrough; an expander linked to the mandrel and operable between an extended position and a retracted position; an extension tool disposed along the mandrel and operable to extend the expander; and a retraction tool disposed along the mandrel. The retraction tool has: an upper piston in fluid communication with the mandrel bore and operable to retract the expander; a lower piston in fluid communication with the mandrel bore and operable to balance the upper piston; a valve disposed between the pistons for isolating the lower piston from the upper piston in a closed position; and an electronics package linked to the valve for opening and closing the valve in response to receiving a command signal.

In another embodiment, a method for expanding a liner string in a wellbore includes: running a liner string into the wellbore using a workstring having a liner deployment assembly (LDA) releasably connected to the liner string; after running the liner string, extending an expander of the LDA; pressurizing an expansion chamber formed between the LDA and the liner string and raising the workstring, thereby driving the extended expander through the liner string; sending a command signal to a retraction tool of the LDA, thereby closing a valve of the retraction tool and isolating a balance piston of the retraction tool from a retractor piston thereof; and pressurizing a bore of the workstring against the closed valve to operate the retractor piston, thereby retracting the expander.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
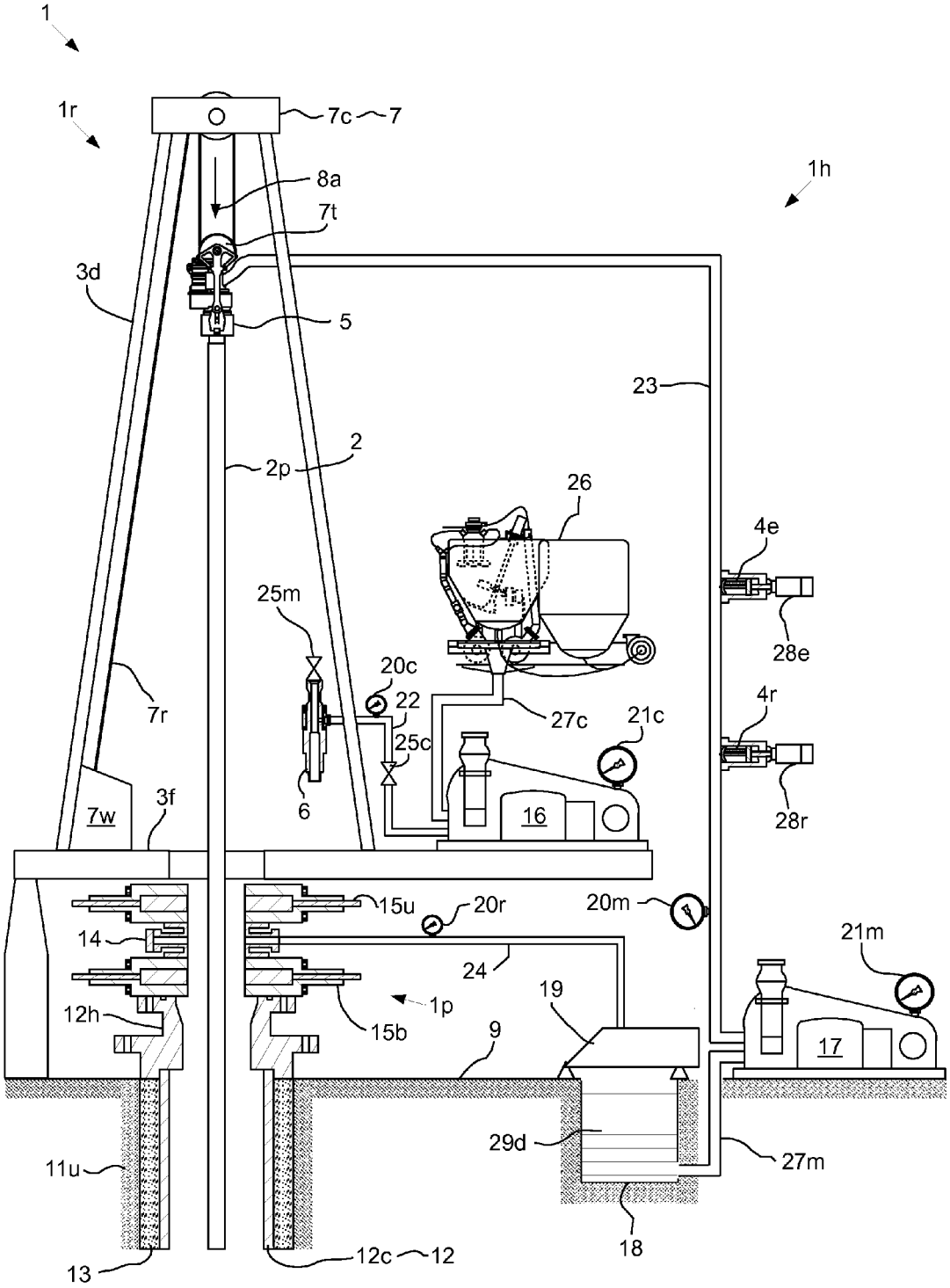
FIGS. 1A-1C illustrate deployment of an expandable liner string into a wellbore using a drilling system having a workstring, according to one embodiment of the present disclosure.
Figure 1B:
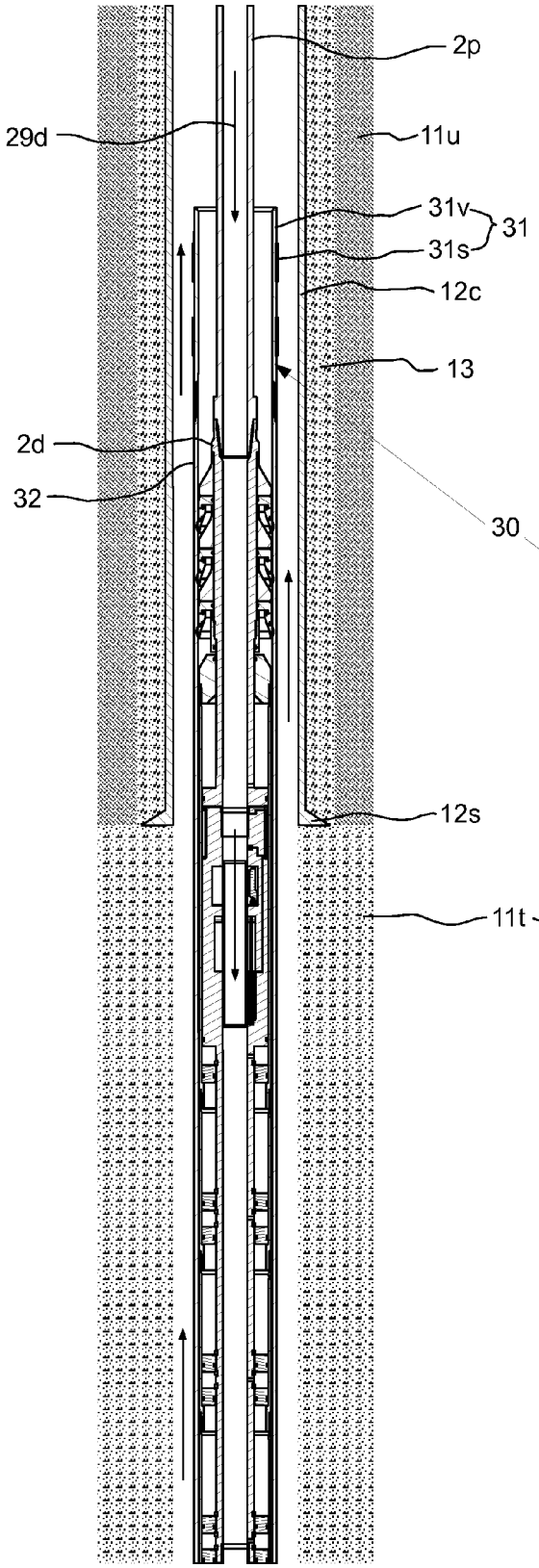
Figure 1C:
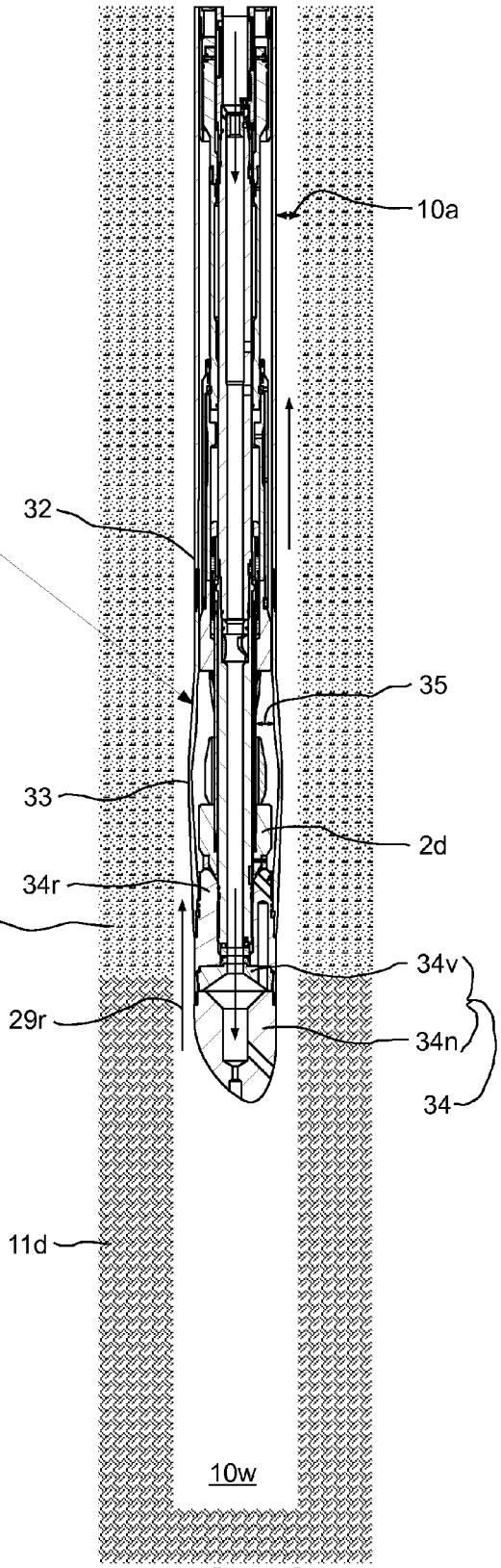
Figures 2A, 2B, 2C, 2D:
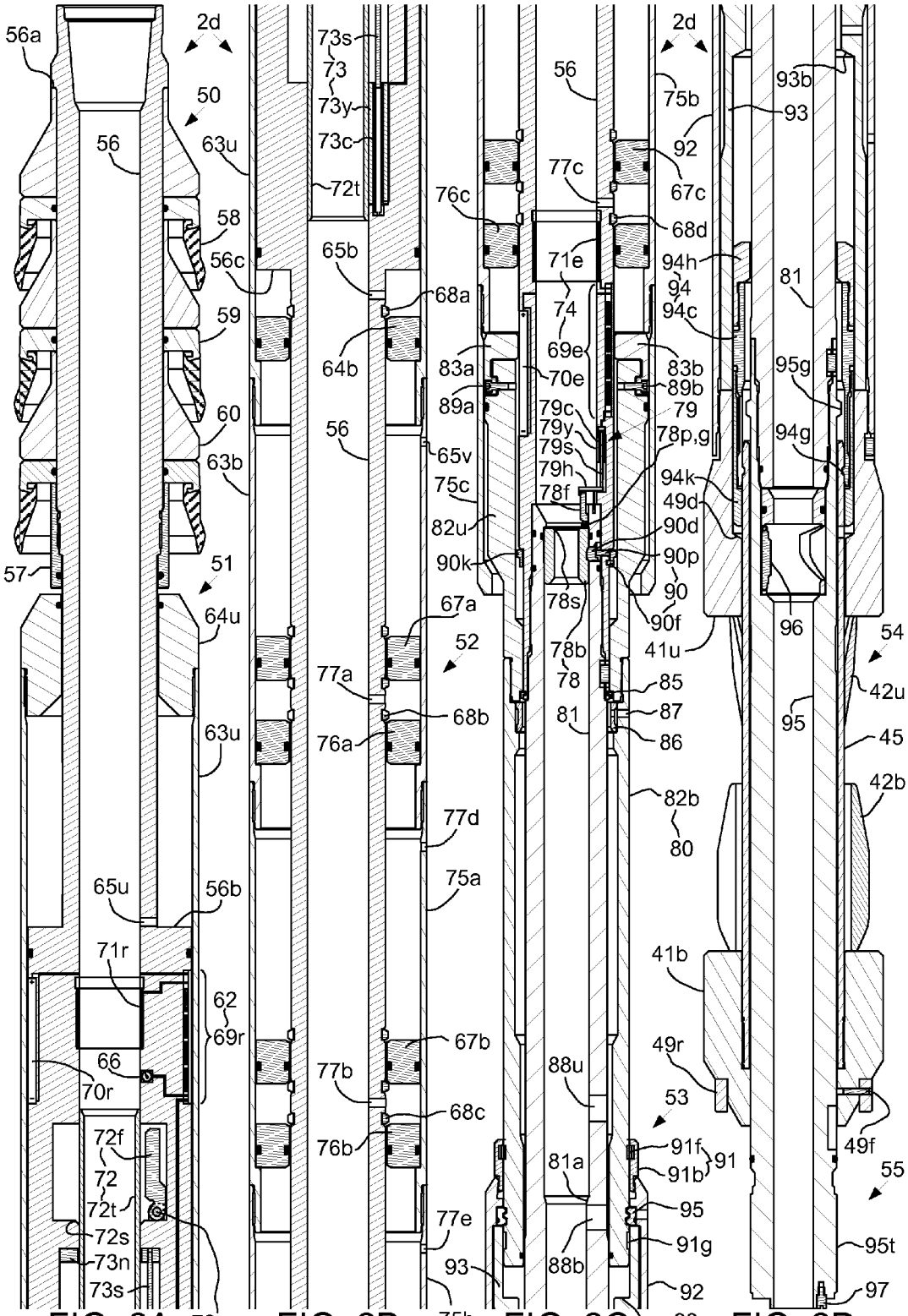
FIGS. 2A-2D illustrate a liner deployment assembly of the workstring.

FIGS. 1A-1C illustrate deployment of an expandable liner string 30 into a wellbore 10*w* using a drilling system 1 having a workstring 2, according to one embodiment of the present disclosure. The drilling system 1 may include a drilling rig 1*r*, a fluid handling system 1*h*, a blowout preventer (BOP) stack 1*p*, and the workstring 2.

The drilling rig 1*r* may include a derrick 3*d*, a floor 3*f*, a rotary table (not shown), a spider (not shown), a top drive 5, a cementing head 6, and a hoist 7. The top drive 5 may include a motor for rotating 8*r* (FIG. 8A) the workstring 2. The top drive motor may be electric or hydraulic. A frame of the top drive 5 may be linked to a rail (not shown) of the derrick 3*d* for preventing rotation thereof during rotation 8*r* of the workstring 2 and allowing for vertical movement of the top drive with a traveling block 7*t* of the hoist 7. A quill of the top drive 5 may be torsionally driven by the top drive motor and supported from the frame by bearings. The top drive 5 may further have an inlet connected to the frame and in fluid communication with the quill. The traveling block 7*t* may be supported by wire rope 7*r* connected at its upper end to a crown block 7*c*. The wire rope 7*r* may be woven through sheaves of the blocks 7*c,t* and extend to drawworks 7*w* for reeling thereof, thereby raising or lowering the traveling block 7*t* relative to the derrick 3*d*.

Alternatively, a Kelly and rotary table may be used instead of the top drive 5.

A wellbore 10*w* may have already been drilled from a surface 9 of the earth into an upper formation 11*u* and a casing string 12 may have been deployed into the wellbore. An upper and/or lower portion of the wellbore 10*w* may be vertical (shown), or deviated (not shown), such as slanted or horizontal. The casing string 12 may include a wellhead 12*h*, joints of casing 12*c*, and a tieback shoe 12*s* connected together, such as by threaded couplings. The casing string 12 may have been cemented 13 into the wellbore 10*w*. The casing string 12 may extend to a depth adjacent to a top of a trouble zone 11*t*. The wellbore 10*w* may then be extended through the trouble zone 11*b* and to an intermediate formation 11*d* using a drill string (not shown). The upper and intermediate formations 11*u,d* may be non-productive. The trouble zone 11*t* may be lost-circulation, subsalt, rubble, overpressured, or a nuisance hydrocarbon bearing pocket. Once the trouble zone 11*t* has been lined, the wellbore 10*w* may be further extended through the intermediate formation 11*d* to a hydrocarbon bearing production zone (not shown).

Alternatively, the wellbore 10*w* may be subsea instead of subterranean and the wellhead 12*h* may be located adjacent to the seafloor or the waterline.

Figures 7A, 7B, 7C, 7D:
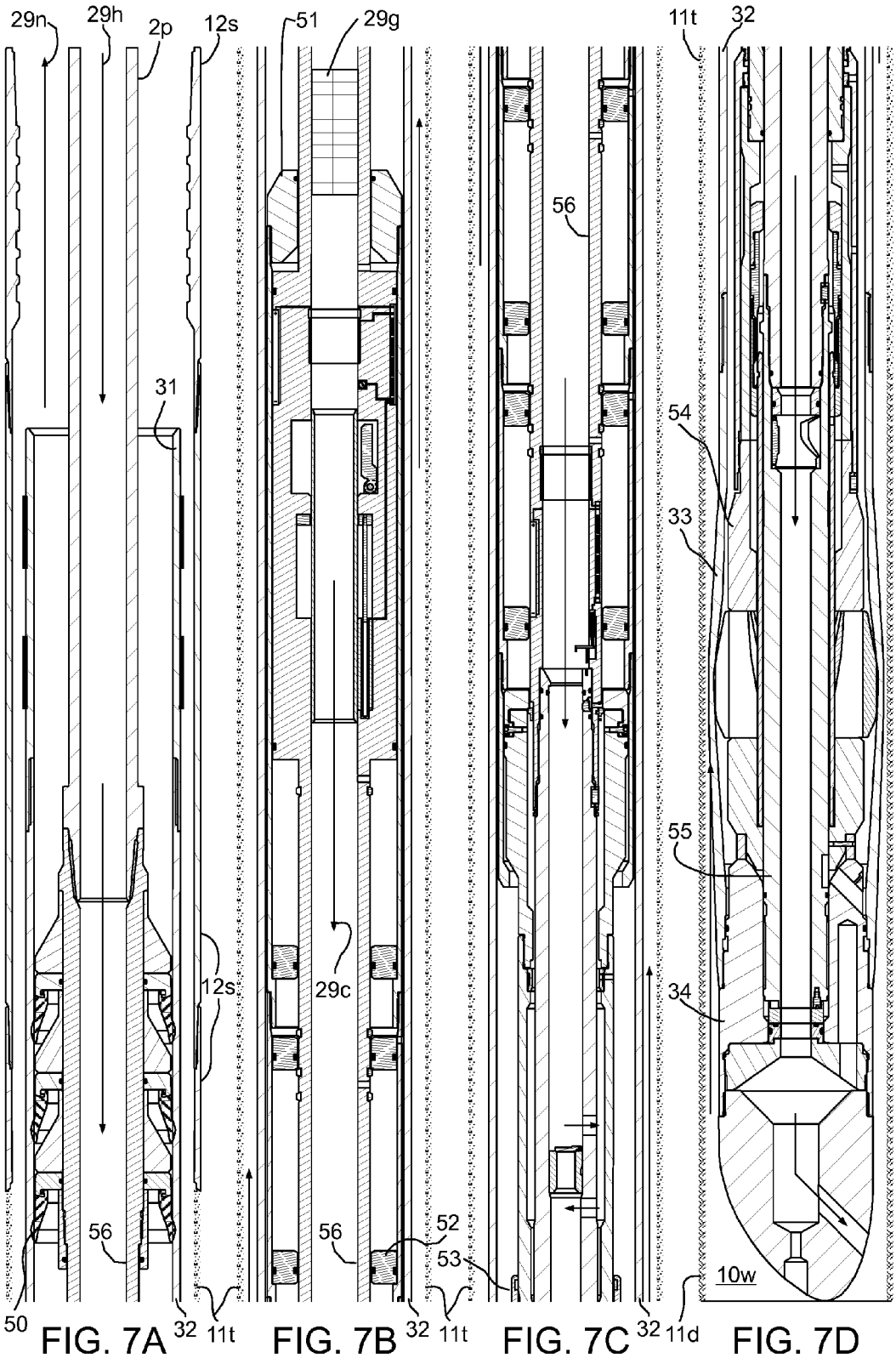
FIGS. 7A-7D illustrate cementing of the liner string.

The BOP stack 1*p* may be connected to the wellhead 12*h*, such as by flanges and fasteners. The BOP stack 1*p* may include a flow cross 14 and one or more BOPS 15*u,b*. The fluid handling system 1*h* may include one or more pumps, such as a cement pump 16, a mud pump 17, a reservoir, such as a pit 18 or tank (not shown), a solids separator, such as a shale shaker 19, one or more pressure gauges 20*c,m,r*, one or more stroke counters 21*c,m*, one or more flow lines, such as cement line 22, mud line 23, and return line 24, one or more shutoff valves 25*c,m*, a cement mixer 26, one or more feed lines 27*c,m*, and one or more tag launchers 28*e,r*. When the drilling system 1 is in a drilling mode (not shown) and the deployment mode, the pit 18 may be filled with drilling fluid 29*d*. In the cementing mode, the pit 18 may be filled with chaser fluid 29*h* (FIG. 7A).

A first end of the return line 24 may be connected to an outlet of the flow cross 14 and a second end of the return line may be connected to an inlet of the shaker 19. The returns pressure gauge 20*r* may be assembled as part of the return line 24. A lower end of the mud line 23 may be connected to an outlet of the mud pump 17 and an upper end of the mud line may be connected to the top drive inlet. The mud pressure gauge 20*m* and tag launchers 28*e,r* may be assembled as part of the mud line 23. An extender tag 4*e* may be loaded into the launcher 28*e* and a retractor tag 4*r* may be loaded into the launcher 28*r*.

Each tag launcher 28*e,r* may include a housing, a plunger, an actuator, and a magazine (not shown) having a plurality of respective tags 4*e,r* loaded therein. A respective chambered tag 4*e,r* may be disposed in the respective plunger for selective release and pumping downhole to communicate with a liner deployment assembly (LDA) 2*d* of the workstring 2. The plunger of each tag launcher 28*f,r* may be movable relative to the respective launcher housing between a capture position and a release position. The plunger may be moved between the positions by the actuator. The actuator may be hydraulic, such as a piston and cylinder assembly.

Alternatively, the actuator may be electric or pneumatic. Alternatively, the actuator may be manual, such as a handwheel. Alternatively, the tags 4*e,r* may be manually launched by breaking the connection between the top drive 5 and the workstring 9.

Figures 4A, 4B, 4C, 4D:
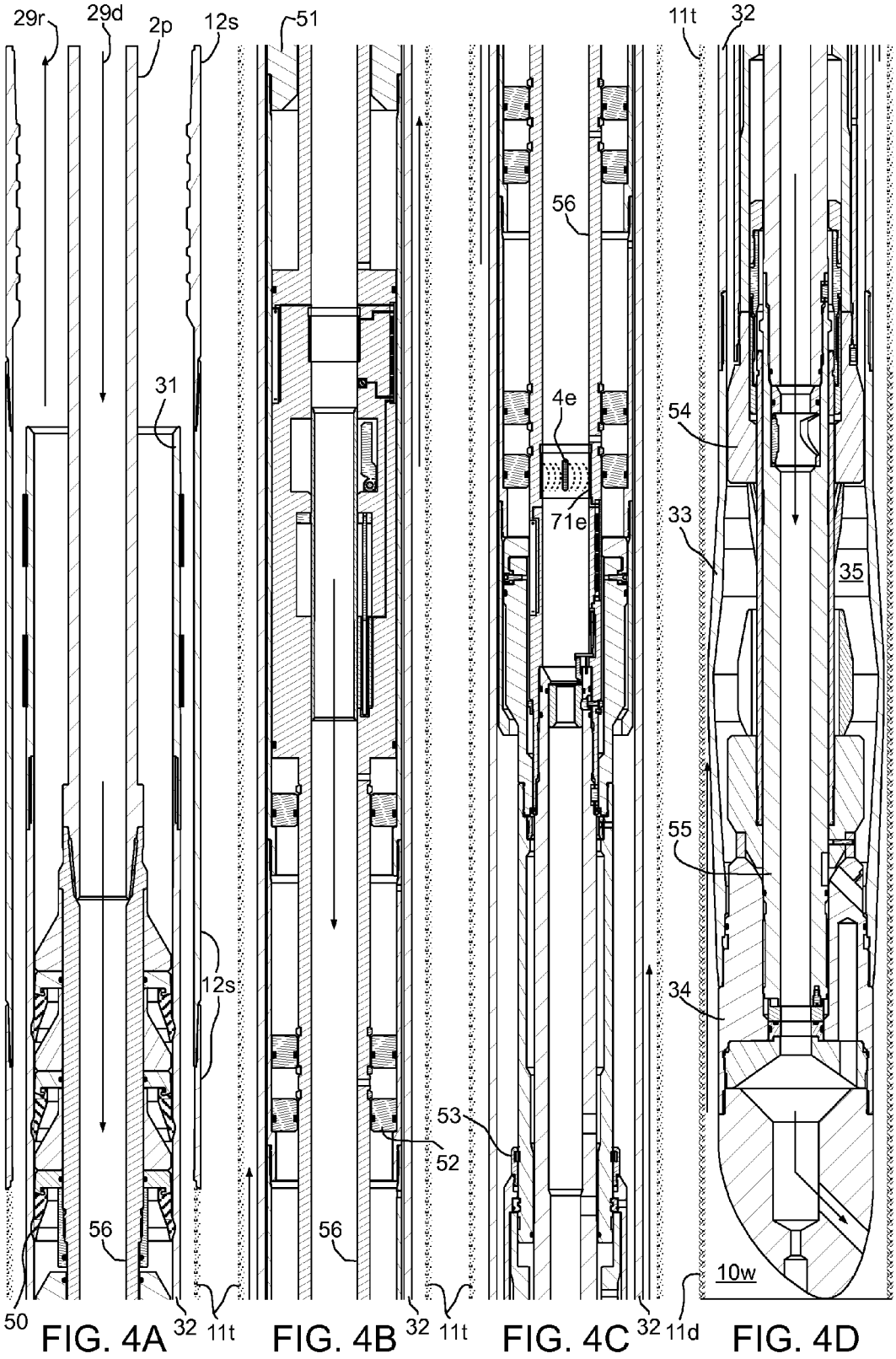
FIGS. 4A-4D illustrate pumping of an extender tag to the liner deployment assembly.
Figures 10A, 10B, 10C, 10D:
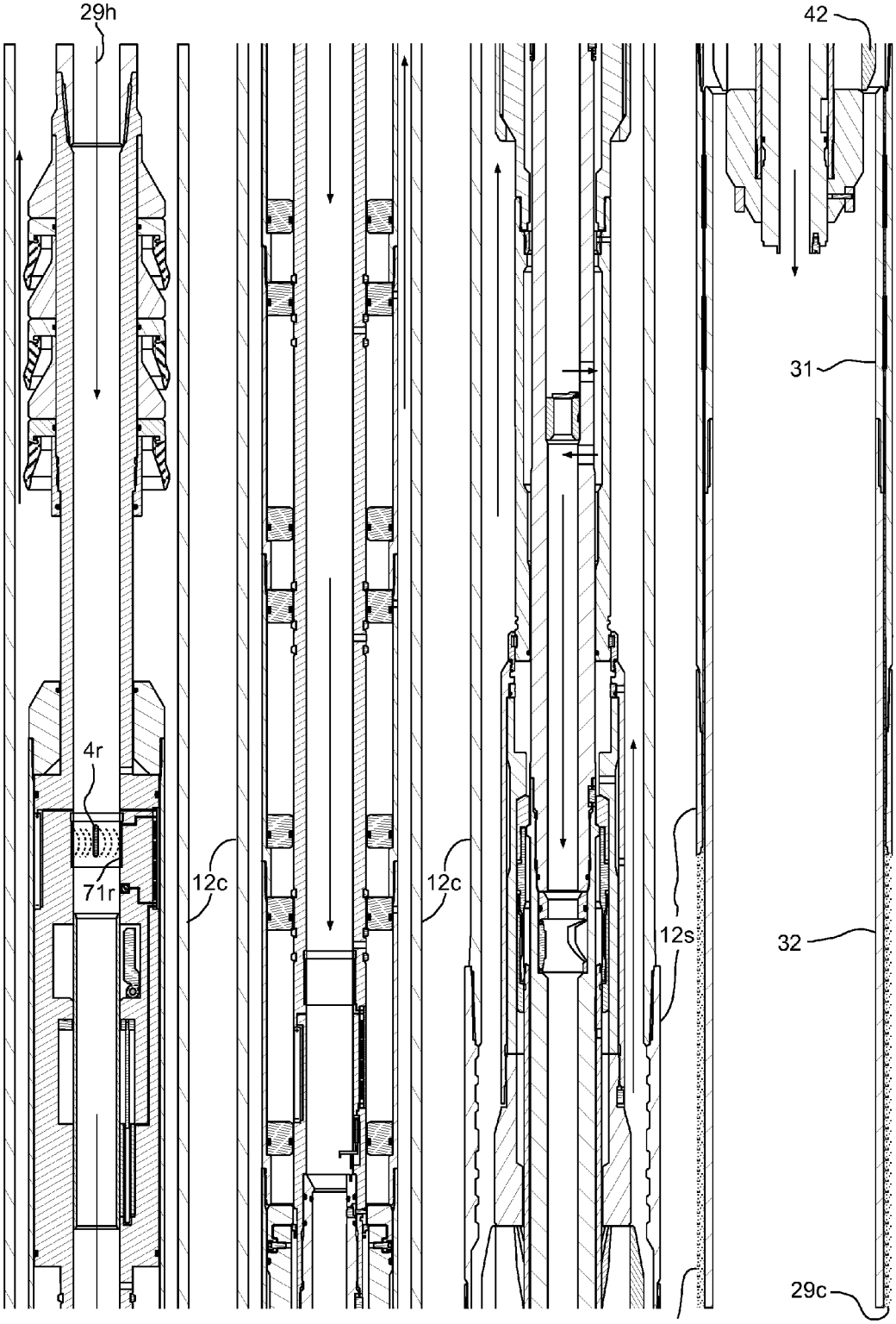
FIGS. 10A-10D illustrate pumping of a retractor tag to the liner deployment assembly.

Each tag 4*e,r* may be a radio frequency identification tag (RFID), such as a passive RFID tag, and include an electronics package and one or more antennas housed in an encapsulation. The electronics package may include a memory unit, a transmitter, and a radio frequency (RF) power generator for operating the transmitter. The extender RFID tag 4*e* may be programmed with a command signal addressed to an extension tool 52 of the LDA 2*d*. The retractor RFID tag 4*r* may be programmed with a command signal addressed to a retraction tool 51 of the LDA 2*d*. Each RFID tag 4*e,r* may be operable to transmit a wireless command signal (FIGS. 4C and 10A), such as a digital electromagnetic command signal, to a respective antenna 71*e,r* of the LDA 2*d* in response to receiving an activation signal therefrom.

An upper end of the cement line 22 may be connected to the cementing head 6 and a lower end of the cement line may be connected to an outlet of the cement pump 16. The cement shutoff valve 25*c* and the cement pressure gauge 20*c* may be assembled as part of the cement line 22. A lower end of the mud feed line 27*m* may be connected to an outlet of the pit 18 and an upper end of the mud feed line may be connected to an inlet of the mud pump 17. An upper end of the cement feed line 27*c* may be connected to an outlet of the cement mixer 26 and a lower end of the cement feed line may be connected to an inlet of the cement pump 16.

The cementing head 6 may include the shutoff valve 25*m* and a cementing swivel. In the deployment mode, the cementing head 6 may be in a standby position. To shift the drilling system 1 into a cementing mode, the workstring 2 may be disconnected from the top drive 5 and the cementing head 6 may be inserted and connected between the top drive 5 and the workstring 2 by connecting the shutoff valve 25*m* to the quill and connecting the cementing swivel to the top of the workstring 2.

Alternatively, the cementing swivel may instead be a non-rotating cementing injector.

When the drilling system 1 is in the deployment mode, an upper end of the workstring 2 may be connected to the top drive quill, such as by threaded couplings. The workstring 2 may include the LDA 2*d* and a work stem 2*p*, such as joints of drill pipe connected together by threaded couplings. An upper end of the LDA 2*d* may be connected a lower end of the work stem 2*p*, such as by threaded couplings. The LDA 2*d* may also be releasably connected to the liner string 30.

Alternatively, the work stem 2*p* may be coiled tubing instead of drill pipe.

The expandable liner string 30 may include a tieback head 31, one or more joints of liner 32, a forming chamber 33, and a shoe 34 interconnected, such as by threaded couplings. The tieback head 31 may include a sleeve 31*v* and one or more (pair shown) seals 31*s*. The head sleeve 31*v* and liner 32 may be made from a ductile metal or alloy capable of sustaining plastic deformation. The head seals 31*s* may be disposed in respective grooves formed in and along an outer surface of the head sleeve 31*v* and be made from an elastomer or elastomeric copolymer.

Alternatively, the tieback head 31 may be an expandable liner hanger further including one or more sets of grippers secured to an outer surface of the head sleeve 31*v* and made from a hard material, such as tool steel, ceramic, or cement, for engaging and penetrating an inner surface of the casing 12*c*, thereby anchoring the liner string 30 to the casing. The gripper sets may be disposed along the head sleeve 31*v* in an alternating fashion with the head seals 31*s*.

The forming chamber 33 may have a launch profile formed in an inner surface thereof to facilitate extension of an expander 54 of the LDA 2*d*. The launch profile may be tapered for conforming to a conical outer surface of the extended expander 54. The forming chamber 33 may be made from a drillable material, such as a nonferrous metal or alloy.

The shoe 34 may include a latch receptacle 34*r*, a gate valve 34*v*, and a guide nose 34*n*. The shoe 34 may be made from a drillable material, such as a nonferrous metal or alloy. The latch receptacle 34*r* may have a coupling, such as a thread, formed in an inner surface thereof for engagement with a coupling of a running tool 55 of the LDA 2*d*, thereby releasably connecting the LDA and the liner string 30. The thread may be opposite-handed relative to the threaded connections of the workstring 2.

The gate valve 34*v* may include a shoulder for receiving a lower end of the running tool 55, a body, a valve member, and a valve seat. The body may be connected to the latch receptacle 34*r*, such as by threaded couplings. The shoulder may have a torsional profiled formed in an inner surface thereof for mating with a torque key 97 of the running tool 55, thereby torsionally connecting the valve member and the running tool. The valve member may be operated from an open position (shown) to a closed position (FIG. 8D) as the LDA is being rotated 8*r* to release the running tool from the liner shoe 34. The closed valve member may shutoff a bore of the shoe 34, thereby isolating the guide nose 34*n* from a bore of the liner string 30.

The guide nose 34*n* may be connected to the latch receptacle 34*r*, such as by threaded couplings. The guide nose 34*n* may have a guide profile formed in an outer surface thereof, a bore extending therethrough, and a flow port extending from the bore to an annulus 10*a* formed between the liner string 30/workstring 2 and the wellbore 10*w*/casing 12*c*.

During deployment of the liner string 30, the workstring 2 may be lowered 8*a* by the traveling block 7*t*. The drilling fluid 29*d* may be pumped into the workstring bore by the mud pump 17 via the mud line 23 and top drive 5. The drilling fluid 29*d* may flow down the workstring bore and the liner string bore and be discharged by the shoe 34 into the annulus 10*a*. The returning drilling fluid 29*r* may flow up the annulus 10*a* and enter the return line 24 via an annulus of the BOP stack 1*p*. The returning drilling fluid 29*r* may flow through the return line 24 and into the shale shaker inlet. The returning drilling fluid 29*r* may be processed by the shale shaker 19 and discharged into the pit 18. The workstring 9 may be lowered until the liner string 30 reaches a desired deployment depth, such as when the tieback head 31 is located adjacent to the tieback shoe 12*s*.

FIGS. 2A-2D illustrate the LDA 2*d*. The LDA 2*d* may include a packoff 50, the retraction tool 51, the extension tool 52, a slip joint 53, the expander 54, and the running tool 55. The packoff 50 may include an upper portion of a mandrel 56, one or more (three shown) seal assemblies, and a retainer 57. The mandrel 56 may be tubular and have threaded couplings formed at longitudinal ends thereof. The upper threaded coupling may connect the LDA 2*d* to the work stem 2*p*. Although shown as one piece, the mandrel 56 may include two or more sections interconnected, such as by threaded couplings.

An expansion chamber 35 (FIG. 1C) may be formed radially between the liner string 30 and the LDA 2*d* and longitudinally between the packoff 50 and the liner shoe 34. Each seal assembly may be disposed around an outer surface of the mandrel 56 and include a directional seal, such as a cup seal 58, a gland 59, and a spacer 60. A seal may be disposed in an interface formed between each gland 59 and the mandrel 56. Each cup seal 58 may be connected to the respective gland 59, such as molding or press fit. An outer diameter of each cup seal 58 may correspond to an unexpanded drift diameter of the liner 32, such as being slightly greater than the drift diameter. Each cup seal 58 may oriented to sealingly engage the liner 32 in response to pressure in the expansion chamber 35 being greater than pressure in the annulus 10*a*. The packoff 50 may be connected to the mandrel 56 by entrapment between a first shoulder 56*a* formed in an outer surface of the mandrel and the retainer 57. The retainer 57 may be connected to the mandrel 56, such as by having a threaded coupling formed in an inner surface thereof engaged with a threaded coupling formed in an outer surface of the mandrel.

The retraction tool 51 may include an intermediate portion of the mandrel 56, a piston assembly, and an actuator 62. The piston assembly may include one or more: sleeves 63*u,b*, pistons 64*u,b*, chambers, and ports 65*u,b,v*. The upper retractor piston 64*u* may be annular, disposed around an outer surface of the mandrel 56, and have a threaded coupling formed at a lower end thereof. The retractor piston 64*u* may carry a sliding seal in an inner surface thereof engaged with the mandrel outer surface for isolating a release chamber from the expansion chamber 35. An upper face of the retractor piston 64*u* may be exposed to the expansion chamber 35. The upper sleeve 63*u* may have threaded couplings formed at longitudinal ends thereof for connection to the retractor piston 64*u* at an upper end thereof and for connection to the lower sleeve 63*b* at a lower end thereof. The lower sleeve 63*b* may have threaded couplings formed at longitudinal ends thereof for connection to an upper sleeve 75*a* of the extension tool 52 at a lower end thereof.

The release chamber may be formed radially between the mandrel 56 and the upper sleeve 63*u* and longitudinally between a second shoulder 56*b* of the mandrel and a lower face of the retractor piston 64*u*. An upper retraction port 65*u* may be formed through a wall of the mandrel 56 and may provide fluid communication between a bore of the mandrel and the release chamber. The mandrel 56 may carry a sliding seal in the outer surface thereof for isolating the release chamber from the actuator 62. A balance chamber may be formed radially between the mandrel 56 and the upper sleeve 63*u* and longitudinally between a third shoulder 56*c* of the mandrel and an upper face of the lower balance piston 64*b*. A lower balance port 65*b* may be formed through a wall of the mandrel 56 and may provide fluid communication between a bore of the mandrel and the balance chamber. The mandrel 56 may carry a sliding seal in the outer surface thereof for isolating the balance chamber from the actuator 62. The upper face of the balance piston 64*b* may have an area equal to an area of the lower face of the retractor piston 64*u*.

Alternatively, the upper face area of the balance piston 64*b* may be slightly greater than the lower face area of the retractor piston 64*u* or a compression spring may be disposed between the third mandrel shoulder 56*c* and the balance piston upper face.

A vent chamber may be formed radially between the mandrel 56 and the lower sleeve 63*b* and longitudinally between a lower face of the balance piston 64*b* and an upper face of an upper bulkhead 67*a*. A port 65*v* may be formed through a wall of the lower sleeve 63*b* and may provide fluid communication between the expansion chamber 35 and the vent chamber. The balance piston 64*b* may be annular and carry an outer seal engaged with an inner surface of the lower sleeve 63*b* and an inner sliding seal engaged with the mandrel outer surface, thereby isolating the balance chamber from the vent chamber. The balance piston 64*b* may be trapped between a shoulder formed in the inner surface of the lower sleeve 63*b* and a first stop 68*a*. The first stop 68*a* may be connected to the mandrel 56, such as by being a snap ring received in a groove formed in the mandrel outer surface.

The actuator 62 may include an electronics package 69*r*, an electrical source, such as a battery 70*r*, an antenna 71*r*, a valve 72, a toggle 73, and a pressure sensor 66. The mandrel 56 may have a battery pocket and an electronics pocket formed in an outer surface thereof and a valve pocket and toggle pocket formed in an inner surface thereof. The mandrel pockets may receive the respective actuator components. The mandrel 56 may also have a sensor socket formed in the inner surface thereof for receiving the pressure sensor 66.

The antenna 71*r* may be tubular and extend along a recess formed in an inner surface of the mandrel 56. The antenna 71*r* may include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. The antenna liner may have a flange formed at an upper end thereof and having a threaded outer surface for connection to the mandrel 56 by engagement with a thread formed in the inner surface thereof.

Leads may be connected to ends of the antenna coil and extend to the electronics package 69*r* via conduit formed in a wall of the mandrel 56. Leads may be connected to ends of the battery 70*r* and extend to the electronics package 69*r* via conduit formed in the wall of the mandrel 56 between the battery pocket and the electronics pocket. Leads may also be connected to the pressure sensor 66 and extend to the electronics package 69*r* via conduit formed in the wall of the mandrel 56 between the sensor socket and the electronics pocket. Leads may also be connected to the toggle 73 and extend to the electronics package 69*r* via conduit formed in the wall of the mandrel 56 between the toggle pocket and the electronics pocket.

The electronics package 69*r* may include a control circuit, a transmitter, a receiver, and a toggle controller integrated on a printed circuit board. The control circuit may include a microcontroller, a memory unit, a clock, and an analog-digital converter. The transmitter may include an amplifier and an oscillator. The receiver may include an amplifier, a demodulator, and a filter. The toggle controller may include a power converter for converting a DC power signal supplied by the battery 70*r* into a suitable power signal for operating the toggle 73. The electronics package 69*r* may also be shrouded in an encapsulation (not shown). The microcontroller of the control circuit may receive the command signal from the retractor tag 4*r* and operate the toggle 73 in response to receiving the command signal.

Figures 11A, 11B, 11C, 11D:
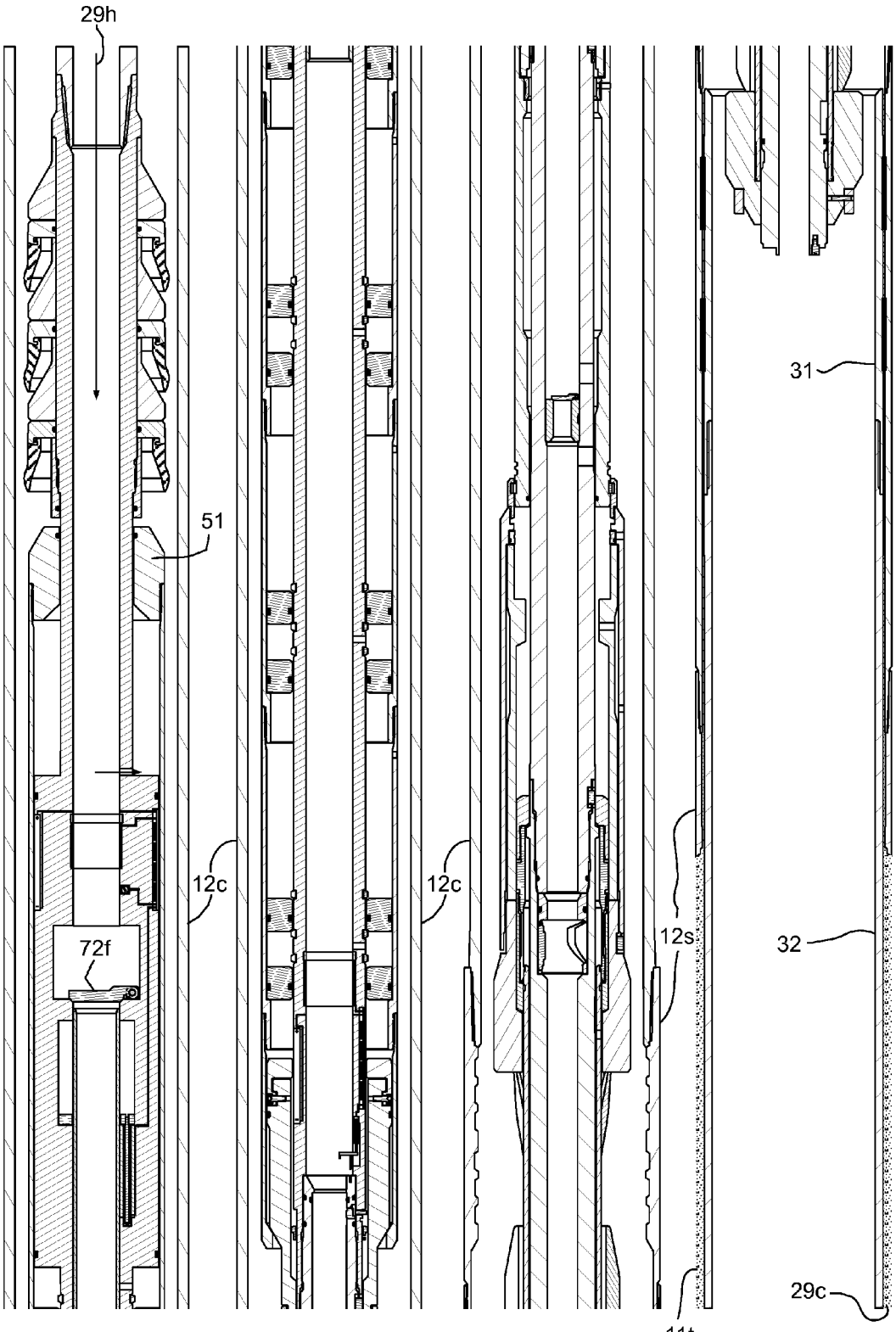
FIGS. 11A-11D illustrate retraction of the expander.
Figure 12A:
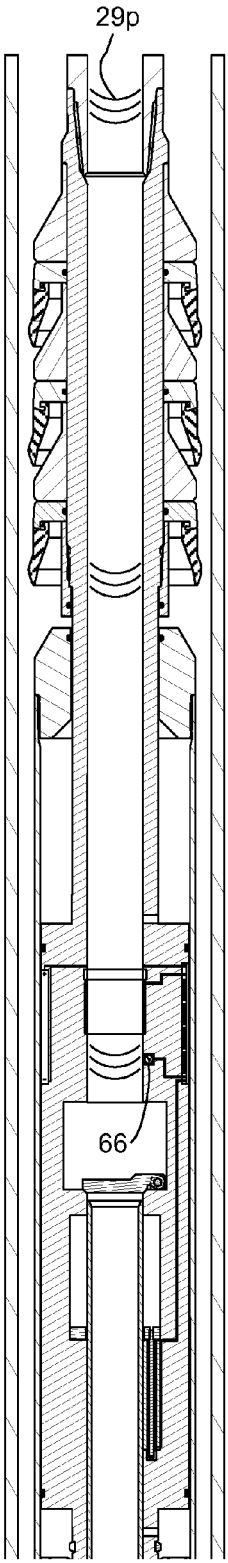
FIGS. 12A-12D illustrate sending an opener pulse to the liner deployment assembly.
Figure 12B:
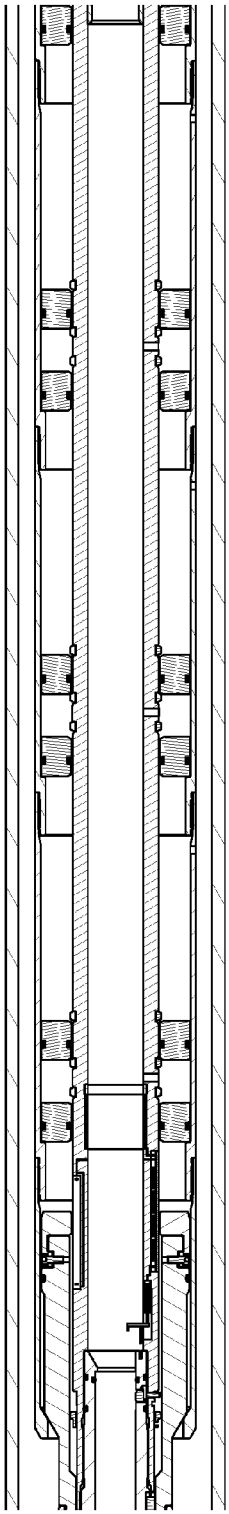
Figure 12C:
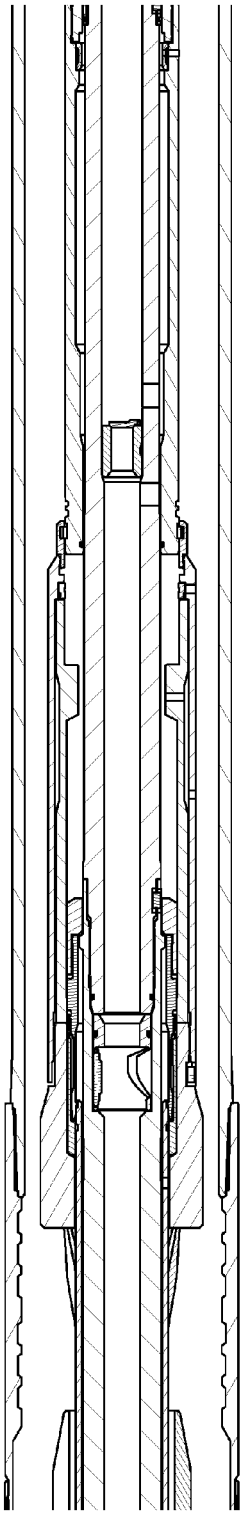
Figure 12D:
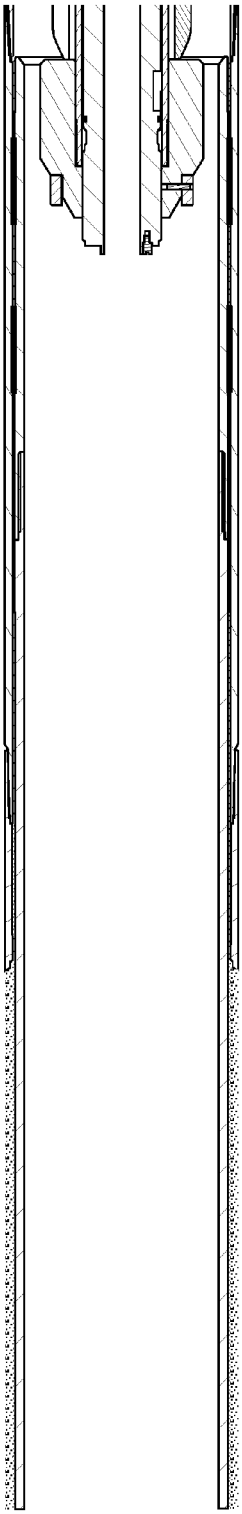
Figures 13A, 13B, 13C, 13D:
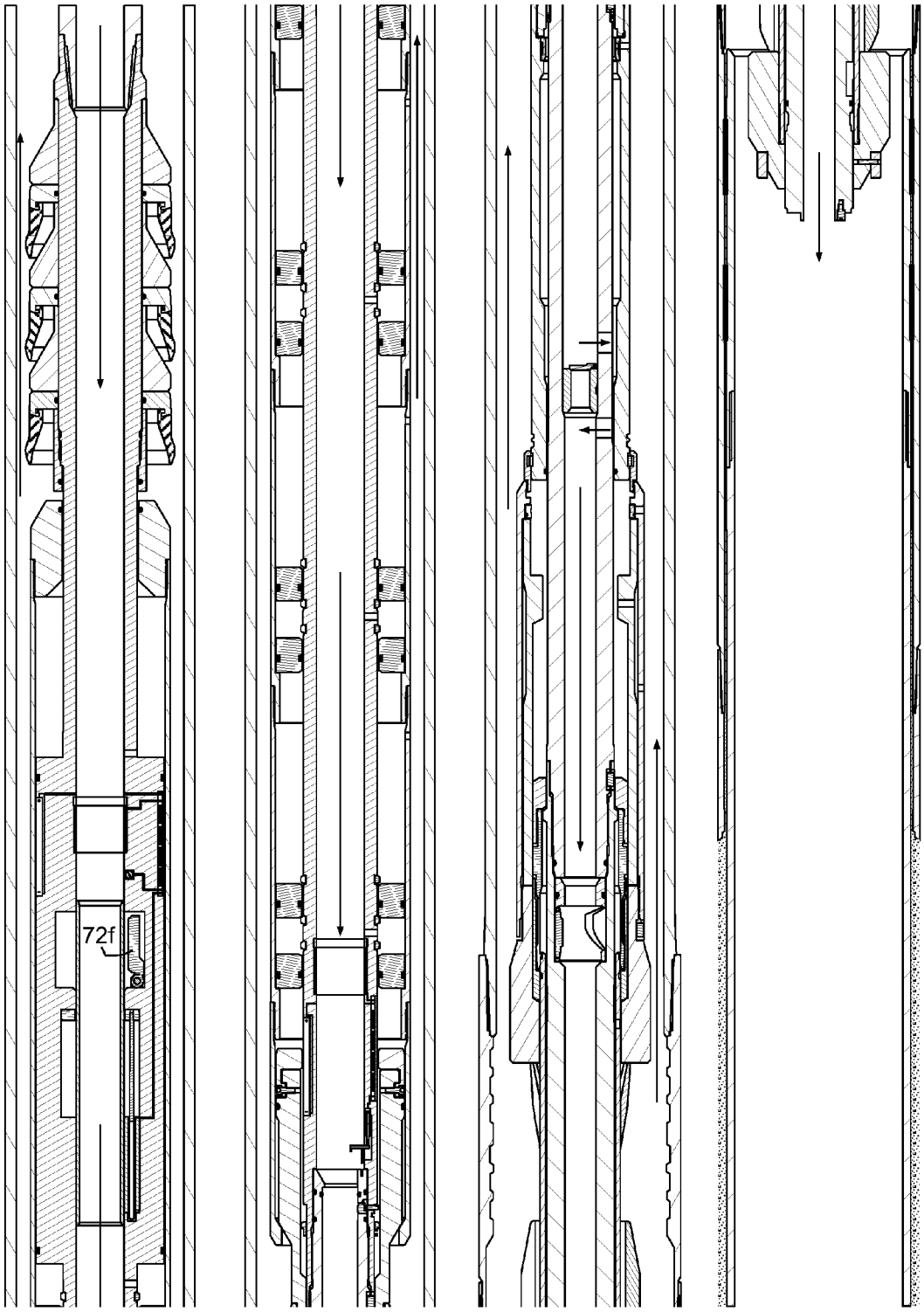
FIGS. 13A-13D illustrate circulation through the liner deployment assembly.

The valve 72 may include a valve member, such as a flapper 72*f*, a seat 72*s*, a flapper pivot 72*p*, a torsion spring 72*g*, and a flow tube 72*t*. The flapper 72*f* may be pivotally connected to the mandrel 56 by the pivot 72*p* and movable between an open position (shown) and a closed position (FIG. 11A). The flapper 72*f* may be biased toward the closed position by the torsion spring 72*g*. The flapper 72*f* may be located between the retraction port 65*u* and the balance port 65*b* such that closure of the flapper isolates the extension tool 52 and the balance piston 64*b* from the retractor piston 64*u* and the work stem 2*p*.

The flow tube 72*t* may be longitudinally movable relative to the mandrel 56 between an upper position (shown) and a lower position (FIG. 11A). The flow tube 72*t* may prop the flapper 72*f* open in the upper position and be clear of the flapper in the lower position, thereby allowing the torsion spring 72*g* to close the flapper. The seat 72*s* may be formed in the inner surface of the mandrel 56 and receive and seal against the flapper 72*f* in the closed position.

The toggle 73 may be a solenoid having a shaft 73*s* connected to the flow tube 72*t*, such as by a nut 73*n*, a cylinder 73*y* connected to the mandrel 56, and a coil 73*c* for longitudinally driving the shaft relative to the cylinder. The toggle 73 may move the flow tube 72*t* between the upper and lower positions. The shaft 73*s* may be stopped in the upper position by engagement of the nut 73*n* with an upper face of the toggle pocket and may be stopped in the lower position by engagement of the nut with a lower face of the toggle pocket.

The extension tool 52 may include a lower portion of the mandrel 56, a piston assembly, and an actuator 74. The piston assembly may include one or more: bulkheads 67*a-c*, sleeves 75*a-c*, pistons 76*a-c*, chambers, and ports 77*a-e*. The sleeves 75*a-c* may be interconnected, such as by threaded couplings.

Each extension chamber (three shown) may be formed radially between the mandrel 56 and the respective sleeve 63*b*, 75*a,b* and longitudinally between a lower face of the respective bulkhead 67*a-c* and an upper face of the respective extender piston 76*a-c*. Each port 77*a-c* may be formed through a wall of the mandrel 56 and may provide fluid communication between the mandrel bore and the respective extension chamber. Each vent chamber (two shown) may be formed radially between the mandrel 56 and the respective sleeve 75*a,b* and longitudinally between a lower face of the respective extender piston 76*a,b* and an upper face of the respective bulkhead 67*b,c*. Each port 77*d,e* may be formed through a wall of the respective sleeve 75*a,b* and may provide fluid communication between the expansion chamber 35 and the respective vent chamber.

Each extender piston 76*a-c* may be annular and carry an outer seal engaged with an inner surface of the respective piston sleeve 63*b*, 75*a,b* and an inner sliding seal engaged with the mandrel outer surface, thereby isolating the respective extension chamber from the adjacent vent chamber or expansion chamber 35. Each extender piston 76*a-c* may be trapped between a shoulder formed in the inner surface of the respective sleeve 63*b*, 75*a,b* and a respective stop 68*b-d*.

Each stop 68*b-d* may be connected to the mandrel 56, such as by being a snap ring received in a groove formed in the mandrel outer surface. Each bulkhead 67*a-c* may be connected to the mandrel 56 by being trapped between a pair of adjacent fasteners, such as snap rings, engaged with respective grooves formed in the outer surface of the mandrel. Each bulkhead 67*a-c* may be annular and carry an outer sliding seal engaged with an inner surface of the respective piston sleeve 63*b*, 75*a,b* and an inner seal engaged with the mandrel outer surface, thereby isolating the respective extension chamber from the adjacent vent chamber.

The actuator 74 may include an electronics package 69*e*, an electrical source, such as a battery 70*e*, an antenna 71*e*, a bore valve 78, a holder 79, a bypass valve 80, and a latch 90. The electronics package 69*e* and antenna 71*e* may be similar to those of the retraction tool actuator 62, discussed above. The microcontroller of the control circuit may receive the command signal from the extender tag 4*e* and operate the holder 79 in response to receiving the command signal. The mandrel 56 may have an additional battery pocket and an electronics pocket formed in an outer surface thereof and an additional valve pocket and toggle pocket formed in an inner surface thereof. The mandrel pockets may receive the respective actuator components. Additional leads and conduits formed in the mandrel 56 may connect the antenna 71*e*, battery 70*e*, and the closer 79 to the electronics package similar to those of the retraction tool actuator 62, discussed above.

The bypass valve 80 may include a body 81, one or more sleeves 82*u,b*, one or more strikers 83*a,b*. The bypass body 81 may be tubular and have threaded couplings formed at longitudinal ends thereof. The upper threaded coupling of the bypass body 81 may be engaged with the lower threaded coupling of the mandrel 56 and the threaded connection may be secured with a fastener, such as a dowel, thereby longitudinally and torsionally connecting the mandrel and the bypass body.

The bypass sleeves 82*u,b* may be interconnected, such as by threaded couplings. Each striker 83*a,b* may be connected to an upper end of the upper sleeve 82*u*, such as by a respective threaded fastener 84*a,b*. The upper bypass sleeve 82*u* and strikers 83*a,b* may be entrapped between a lower face of the sleeve 75*b* and a shoulder formed in an inner surface of the sleeve 75*c*. The upper bypass sleeve 82*u* may have a shoulder formed in an outer surface thereof for engagement with the shoulder of the sleeve 75*c*. The bypass sleeves 82*u,b* may be releasably connected to the bypass body 81, such as by a shearable fastener 85. The lower sleeve 82*b* may carry a ring 86 for protecting the shearable fastener 85. Each of the protector ring 86 and the lower sleeve 82*b* may have an equalization port 87 formed therethrough for providing limited fluid communication between an annular space formed between the body 81 and the sleeves 82*u,b* and the expansion chamber 35. The lower bypass sleeve 82*b* may carry a seal at a lower end thereof for isolating the annular space from the expansion chamber 35. The annular space may have an upper enlarged portion and a lower restricted portion.

Figures 6A, 6B, 6C, 6D:
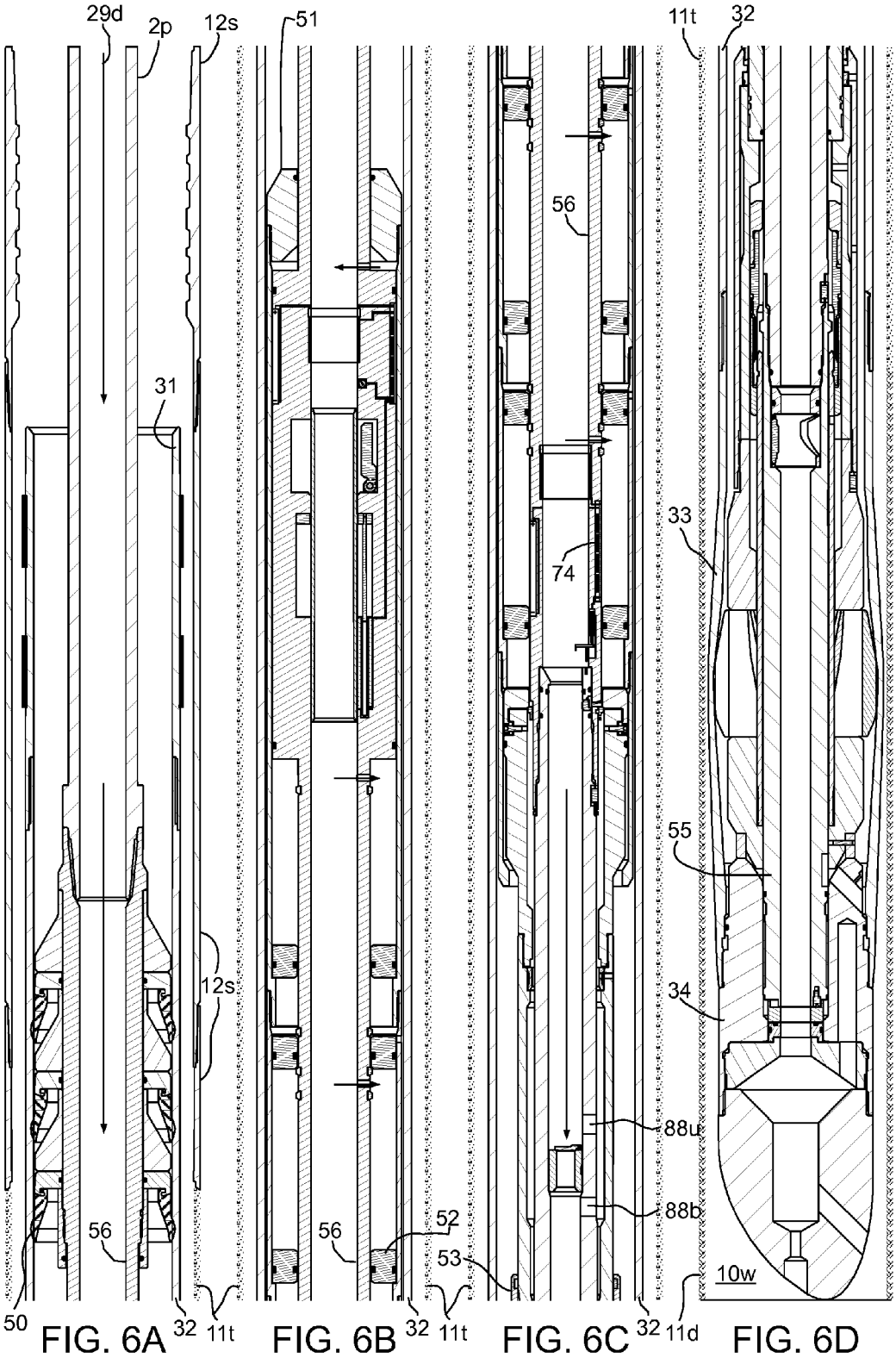
FIGS. 6A-6D illustrate opening of a bypass valve of the liner deployment assembly.

The bypass body 81 may have a landing shoulder 81*a* formed in an inner surface thereof and a pair of bypass ports 88*u,b* formed through a wall thereof straddling the landing shoulder. The bypass sleeves 82*u,b* may be releasably connected to the body in a restricted position (shown). Once released from the bypass body 81, the bypass sleeves 82*u,b* may be longitudinally movable relative thereto to a bypass position (FIG. 6C). In the restricted position, the restricted portion of the annular space may be aligned with the lower bypass port 88*b*. In the bypass position, the enlarged portion of the annular space may be aligned with both bypass ports 88*u,b*, thereby providing unrestricted fluid communication around the landing shoulder 81*a*.

Figures 5A, 5B, 5C, 5D:
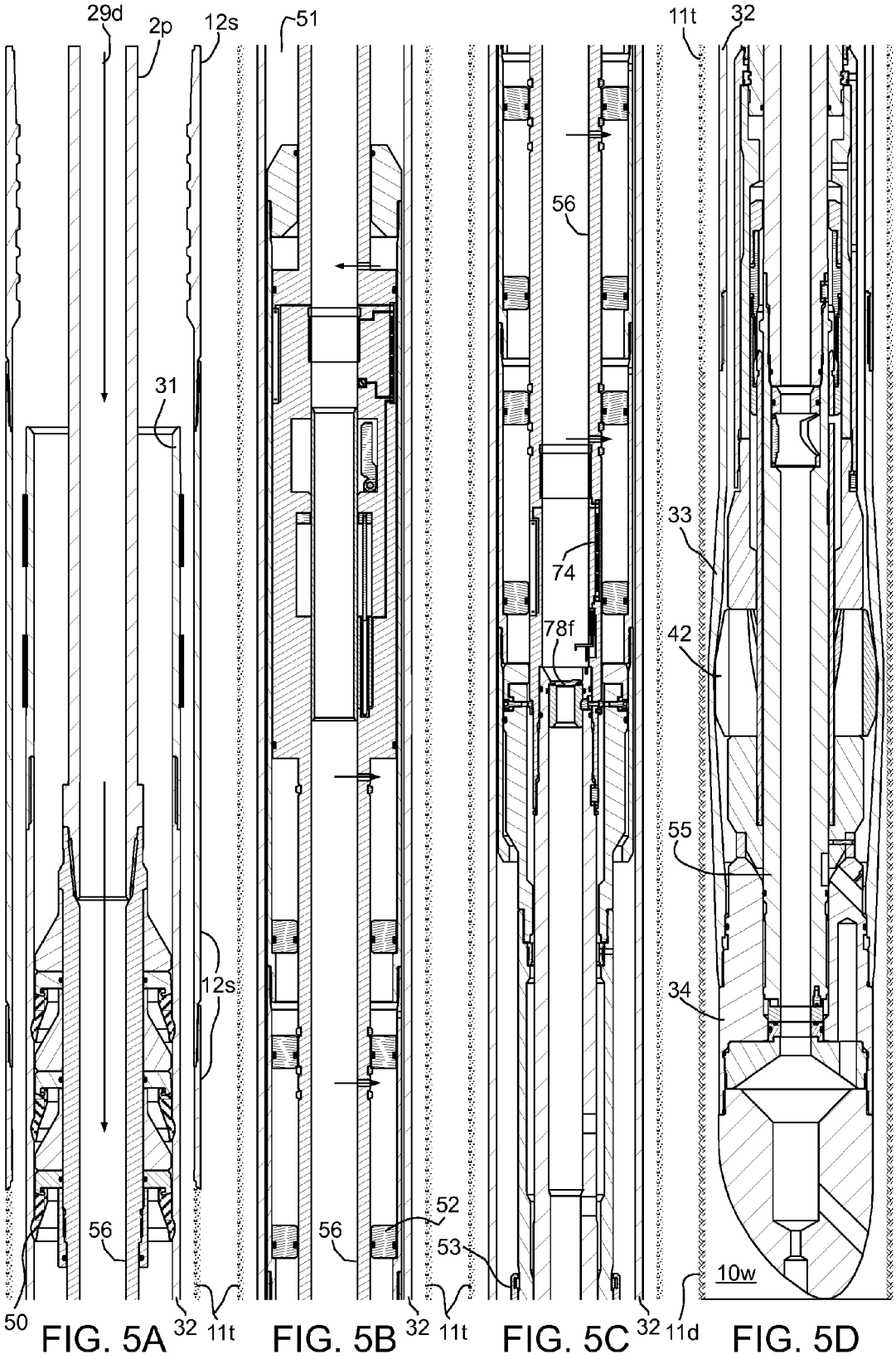
FIGS. 5A-5D illustrate shifting of the expander to the extended position.

The bore valve 78 may include a body 78*b*, a valve member, such as a flapper 78*f*, a seat 78*s*, a flapper pivot 78*p*, and a torsion spring 78*g*. The flapper 78*f* may be pivotally connected to the body 78*b* by the pivot 78*p* and movable between an open position (shown) and a closed position (FIG. 5C). The flapper 78*f* may be biased toward the closed position by the torsion spring 78*g*. The flapper 78*f* may be located below the mandrel ports 65*u,b*, 77*a-c* such that closure of the flapper isolates the work stem 2*p*, retraction tool 51 and extension tool 52 from the expansion chamber 35. The seat 78*s* may be formed in the inner surface of the body 78*b* and receive and seal against the flapper 78*f* in the closed position.

The holder 79 may include a head 79*h* and a solenoid having a shaft 79*s* connected to the head 79*h*, such as by threaded couplings, a cylinder 79*y* connected to the mandrel 56, and a coil 79*c* for longitudinally driving the shaft relative to the cylinder. The head 79*h* may grasp the flapper 78*f* in a lower position (shown), thereby restraining the flapper 78*f* in the open position. Movement of the head 79*h* to the upper position by the solenoid may release the flapper 78*f*, thereby allowing the torsion spring 78*g* to close the flapper. The shaft 79*s* may be stopped in the upper position by engagement of the shaft with the cylinder 79*y* and may be stopped in the lower position by engagement of the head 79*h* with the flapper 78*f*. The head 79*h* may also have a guide stem received by a locator socket formed in the upper face of the bypass body 81 when the head is in the lower position.

The latch 90 may include a fastener, such as a dog 90*d*, a pusher 90*p*, a lock ring 90*k*. The latch 90 may releasably connect the bore valve 78 to the body 81 in an active position (shown). Once released from the body 81, the bore valve 78 may be longitudinally movable relative thereto to an idle position (FIG. 6C). The bypass body 81 may seat against on the landing shoulder 81*a* in the idle position and be clear of the upper bypass port 88*u*. The bypass body 81 may carry outer seals engaged with an inner surface of the mandrel 56 and straddling the latch 90. The bypass body 81 may also carry an inner seal engaged with an outer surface of the bore valve body 78*b* when the bore valve 78 is in the active position. The body 81 may have a window formed through a wall thereof receiving the dog 90*d*, thereby longitudinally trapping the dog.

The dog 90*d* may be radially movable relative to the bypass body 81 between an engaged position (shown) and a disengaged position (FIG. 6C). The bore valve body 78*b* may have an indentation formed in an outer surface thereof and in alignment with the flapper pivot 78*p*. In the engaged position, an inner portion of the dog 90*d* may extend into the indentation, thereby fastening the bore valve 78 to the bypass body 81. The dog 90*d* may be kept in the engaged position by engagement of an outer surface thereof with the pusher 90*p* extending through a socket formed through a wall of the mandrel 56 and the lock ring 90*k* releasably connected to the mandrel in alignment with the pusher. The lock ring 90*k* may be releasably connected to the mandrel by a shearable fastener 90*f*. Engagement of the strikers 83*a,b* with the lock ring 90*k* may fracture the shearable fastener 90*f* and release the lock ring 90*k*, thereby allowing the dog 90*d* to retract.

Figures 9A, 9B, 9C, 9D:
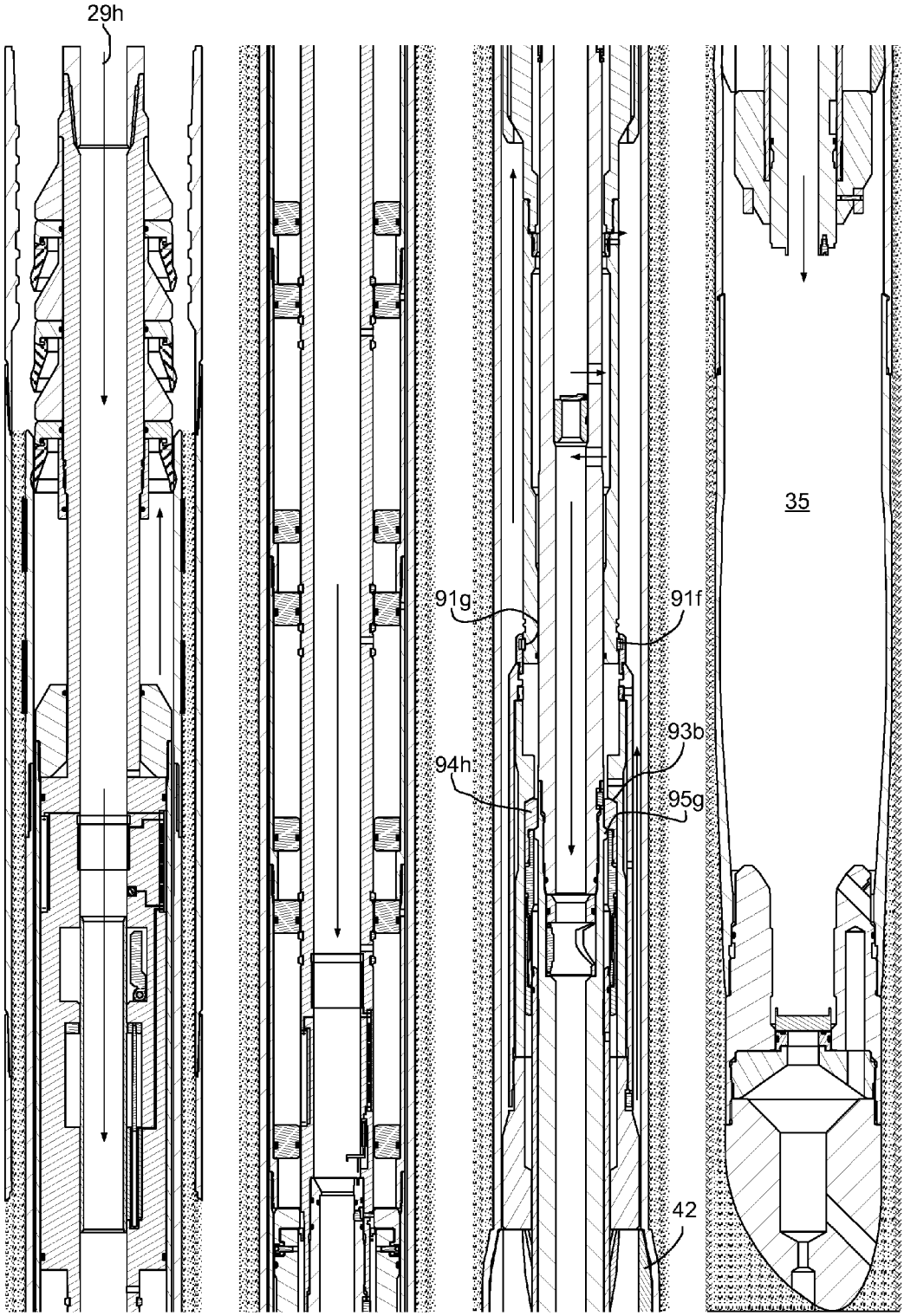
FIGS. 9A-9D illustrate expansion of the liner string.

The slip joint 53 may include an upper latch 91, an outer sleeve 92, an inner sleeve 93, a lower latch 94, and a shearable fastener 95. The upper latch 91 may include a body 91*b*, a fastener, such as a snap ring 91*f*, and a latch groove 91*g* formed in an outer surface of the lower bypass sleeve 82*b*. The latch body 91*b* may be connected to an upper end of the outer sleeve 92, such as by threaded couplings. The snap ring 91*f* may be radially movable between an extended position (FIG. 6D) and a retracted position (FIG. 9C). The snap ring 91*f* may be carried in a groove formed in an inner surface of the latch body 91*b* and be naturally biased toward the retracted position. Once aligned, the snap ring 91*f* may retract into the latch groove 91*g*, thereby fastening the outer sleeve 92 to the lower bypass sleeve 82*b*.

A lower end of the outer sleeve 92 may be connected to an upper end ring 41*u* of the expander 54, such as by threaded couplings, and the threaded connection may be secured by a fastener, such as a dowel. The inner sleeve 93 may be trapped between a lower shoulder formed in an inner surface of the outer sleeve 92 and an upper face of the upper end ring 41*u*. The shearable fastener 95 may be engaged with a second latch profile formed in an outer surface of the lower bypass sleeve 82*b* and be trapped between an upper shoulder formed in the inner surface of the outer sleeve 92 and an upper face of the inner sleeve 93, thereby releasably connecting the slip joint sleeves 92, 93 to the lower bypass sleeve 82*b*. The inner sleeve 93 may have an upper recess formed in an inner surface thereof and a lower recess formed in the inner surface thereof. A gap may exist between a lower face of the lower bypass sleeve 82*b* and an upper shoulder 93*u* formed in an inner surface of the inner sleeve 93 and forming a lower end of the upper recess.

The lower latch 94 may include a catch ring 94*h*, a fastener, such as a collet 94*c*, a lock sleeve 94*k*, and a latch groove 94*g* formed in an outer surface of the base tube 45. The collet 94*c* may have a solid upper base portion and split fingers extending from the base portion to a lower end thereof. Each collet finger may have a lug formed at a lower end thereof engaged with the latch groove 94*g*, thereby fastening the catch ring 94*h* to a lower end ring 41*b* of the expander 54. The collet fingers may be cantilevered from the base portion and have a stiffness urging the lugs toward a disengaged position from the latch groove 94*g*. The collet fingers may be forced into engagement with the packer latch groove by entrapment against an inner surface of the lock sleeve 94*k*. The lock sleeve 94*k* may be connected to a lower end of the collet base portion by threaded couplings. The collet base portion may have a threaded coupling formed at an upper end thereof engaged with an inner threaded coupling formed at a lower end of the catch ring 94*h*, thereby connecting the collet 94*c* and the catch ring. A gap may exist between an upper face of the catch ring 94*h* and a lower shoulder 93*b* formed in an inner surface of the inner sleeve 93 and forming an upper end of the lower recess.

The running tool 55 may include a body 95 and a check valve 96. An upper threaded coupling of the running body 95 may be engaged with the lower threaded coupling of the bypass body 81 and the threaded connection may be secured with a fastener, such as a dowel, thereby longitudinally and torsionally connecting the running body and the bypass body. The bypass body 81 may carry an outer seal at a lower end thereof for engaged with an inner surface of the running tool 55, thereby isolating bores of the bypass body and running body 95 from the expansion chamber 35.

Figures 8A, 8B, 8C, 8D:
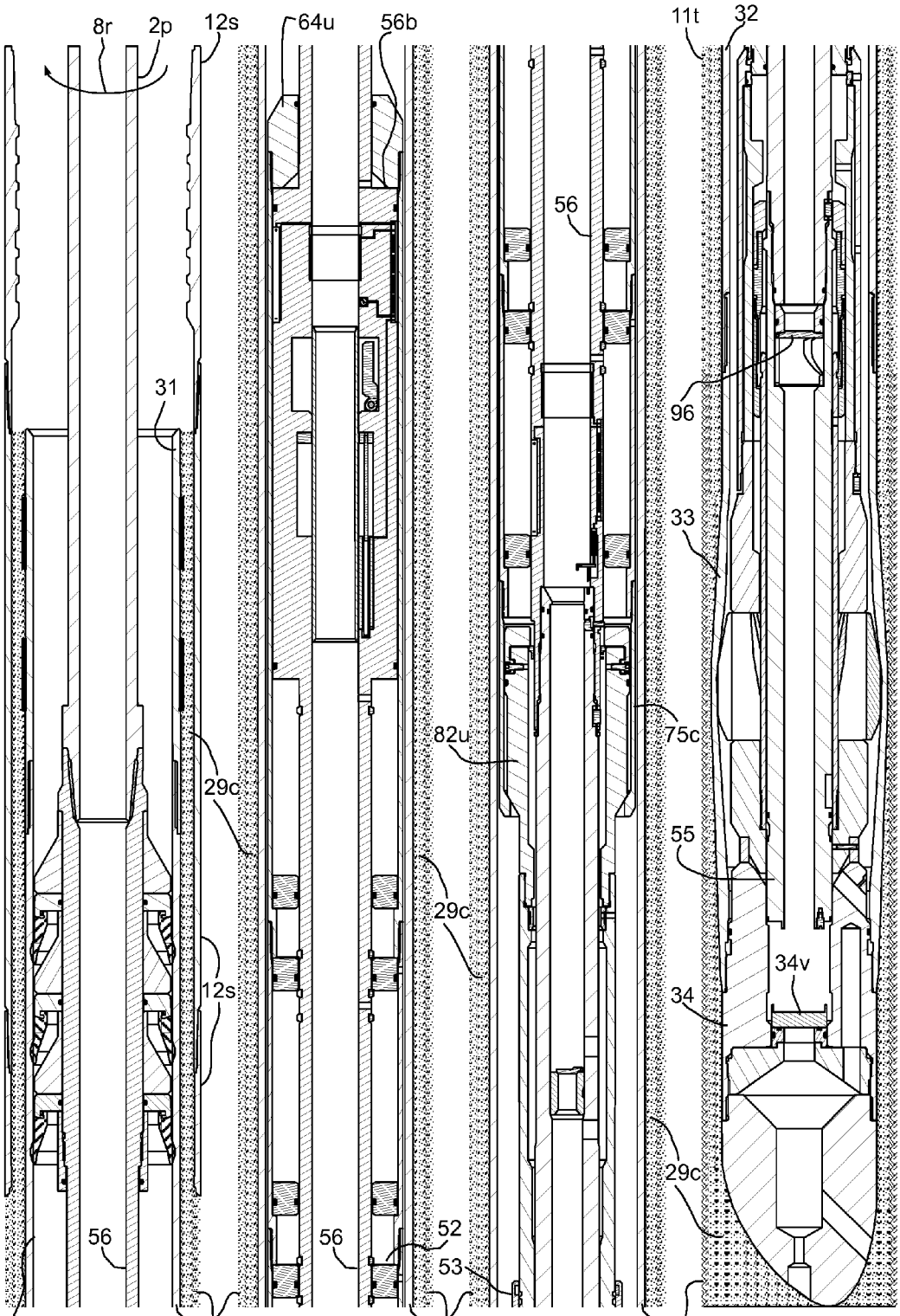
FIGS. 8A-8D illustrate release of the liner deployment assembly from the liner string.

A recess may be formed in an inner surface of the running body 95 at an upper portion thereof. The check valve 96 may be disposed in the recess and trapped therein by a lower face of the bypass body 81. The check valve 96 may include a body, a valve member, such as a flapper, a seat, a flapper pivot, and a torsion spring. The flapper may be pivotally connected to the body by the pivot and movable between an open position (shown) and a closed position (FIG. 8D). The flapper may be biased toward the closed position by the torsion spring. The flapper may open in response to downward flow from the bypass body bore to the running body bore and close in response to reverse flow. The seat may be formed in the inner surface of the valve body and receive and seal against the flapper in the closed position.

The running body 95 may have a lug 95*g* formed in an outer surface thereof. A lower face of the lug 95*g* may engage an upper face of the base tube 45 and an upper face of the lug may engage the catch ring 94*h* during operation of the LDA 2*d*. The running body 95 may have a coupling, such as an opposite-hand thread 95*t*, formed in an outer surface thereof for engagement with the latch receptacle thread 34*r*. The torque key 97 may be fastened to a lower face of the running body 95 to operate the gate valve 34*v*. The running body 95 may carry a seal in an outer surface thereof for engagement with an inner surface of the latch receptacle to isolate the running body bore from the expansion chamber 35.

A saver ring 49*r* may be connected to the lower end ring 41*b* by a fastener 49*f*. The saver ring 49*r* may engage an upper face of the latch receptacle 34*r* to support the lower assembly 40*b* and base tube 45 during liner deployment. The upper end ring 41*u* may have a recess formed in an inner surface thereof for receiving the lock sleeve 94*k* and a shoulder 49*d* forming an upper end of the recess and for engaging a lower face of the lock sleeve 94*k* during operation of the LDA 2*d*.

Figures 3A, 3B:
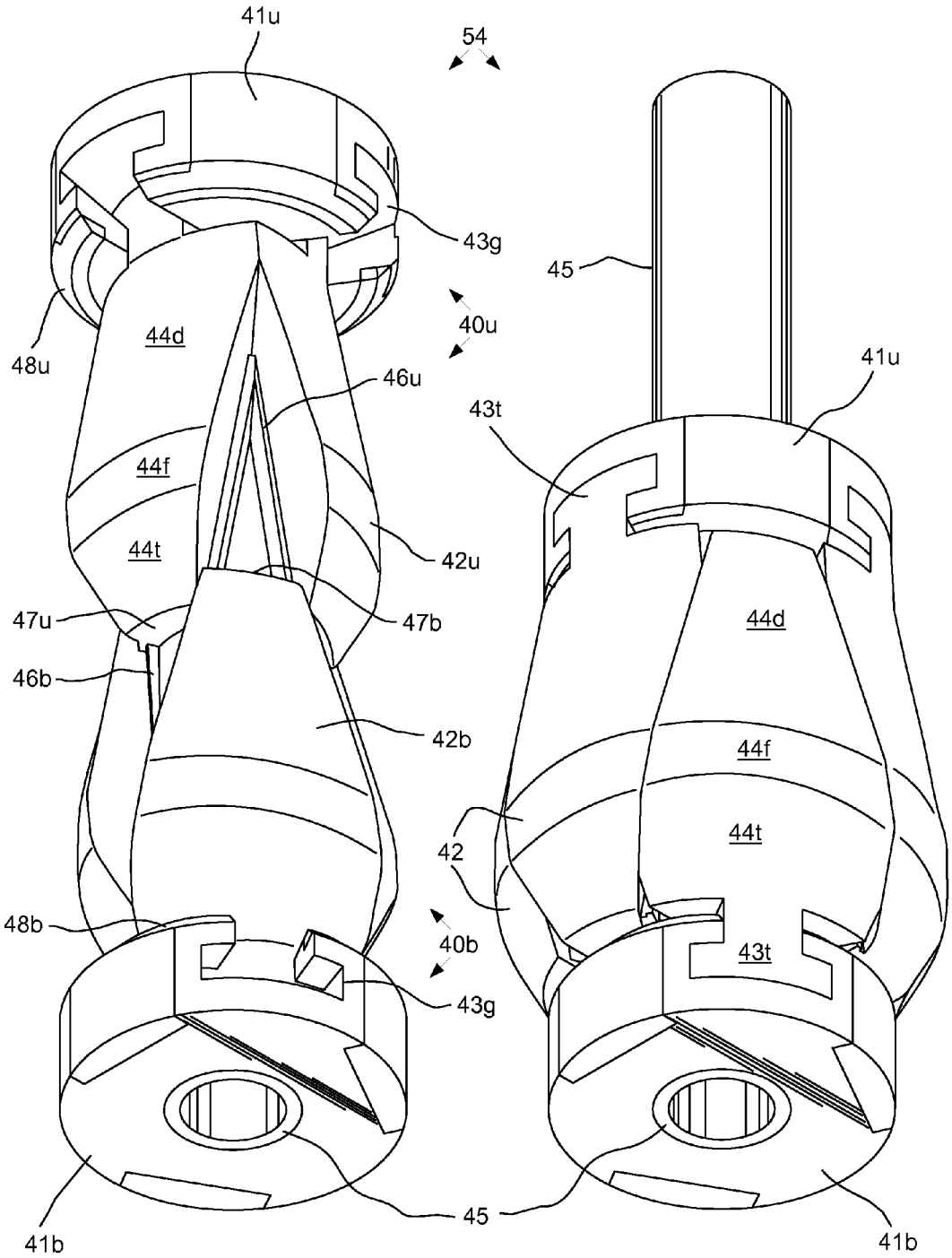
FIG. 3A illustrates an expander of the workstring in a retracted position.
FIG. 3B illustrates the expander in an extended position.

FIG. 3A illustrates the expander 54 in a retracted position. FIG. 3B illustrates the expander 54 in an extended position. The expander 54 may include an upper assembly 40*u*, a lower assembly 40*b*, and the base tube 45. Each assembly 40*u,b* may include the respective end ring 41*u,b* and a plurality of respective cone segments 42*u,b*. The base tube 45 may be connected to the lower end ring 41*b*, such as by threaded couplings while the upper end ring 41*u* may be free to slide along an outer surface of the base tube 45. Each end ring 41*u,b* may have a plurality of respective grooves 43*g* formed in a longitudinal end thereof adjacent to the respective cone segments 42*u,b*. Each cone segment 42*u,b* may have a tongue 43*t* formed in a longitudinal end thereof adjacent to the respective grooves 43*g*. Mating of the tongues 43*t* with the respective grooves 43*g* may longitudinally connect the cone segments 42*u,b* to the respective end rings 41*u,b* while accommodating radial movement of the cone segments relative to the end rings. The tongue and grooves 43*t,g* may be T-shaped.

Each cone segment 42*u,b* may have a lead taper 44*d*, a flat 44*f*, and a trail taper 44*t* formed in an outer surface thereof. The lead tapers 44*d* may have a gradual slope relative to a steeper slope of the trail tapers 44*t*. An inner surface of each cone segment 42*u,b* may be arcuate to conform to an outer surface of the base tube 45. Each upper cone segment 42*u* may have a pair of track portions 46*u*, each track portion formed in an inner surface of the cone segment at a respective circumferential end thereof. Each lower cone segment 42*b* may have a pair of track portions 46*b*, each track portion formed in an inner surface of the cone segment at a respective circumferential end thereof. Mating of the upper track portions 46*u* with the respective lower track portions 46*b* may align and interconnect the cone segments 42*u,b* while accommodating longitudinal movement of the upper cone segments 42*u* relative to the lower cone segments 42*b*.

As the upper assembly 40*u* moves longitudinally along the base tube 45 toward the lower assembly 40*b*, lower faces 47*u* of the upper cone segments 42*u* wedge the lower cone segments 42*b* apart and upper faces 47*b* of the lower cone segments wedge the upper cone segments apart, thereby radially extending the expander 54 and forming a cone 42. The expander 54 may be halted in the extended position by engagement of the lower faces 47*u* with a stop shoulder 48*b* formed in the lower end ring 41*b* and engagement of the upper faces 47*b* with a stop shoulder 48*u* formed in the upper end ring 41*u*. An outer diameter of the cone 42 (maximum at flat portion 44*f*) may be selected to achieve an expanded inner diameter of the liner 32 corresponding to a drift diameter of the casing 12*c* such that a monobore is formed through the casing 12*c* and expanded liner.

FIGS. 4A-4D illustrate pumping of the extender tag 4*e* to the LDA 2*d*. Once the liner string 30 has been advanced 8*a* into the wellbore 10*w* by the workstring 2 to the desired deployment depth, the extender tag launcher 28*e* may be operated and the drilling fluid 29*d* may propel the extender tag 4*e* down the workstring 2 and to the antenna 71*e* of the extension tool 52. The extender tag 4*e* may transmit the command signal to the antenna 71*e* as the tag passes thereby.

FIGS. 5A-5D illustrate shifting of the expander 54 to the extended position. The extender tool microcontroller may receive the command signal from the extender tag 4*e* and may operate the holder controller to energize the coil 79*c*, thereby driving the shaft 79*s* and connected head 79*h* upward to release the flapper 78*f*. The flapper 78*f* may close and continued pumping of the drilling fluid 29*d* may increase pressure in the mandrel bore relative to pressure in the expansion chamber 35. The increased pressure may exert a downward force on the extender pistons 76*a-c* via the respective ports 77*a-c*.

The extender pistons 76*a-c* may in turn exert the downward force on the bypass sleeves 82*u,b* via the extension sleeves 75*a,b*. Downward movement may initially be prohibited by the shearable fastener 85 until a first threshold pressure differential is achieved sufficient to fracture the shearable fastener. The retraction tool 51 may be idle as the pressure differential may exert an upward force on the retractor piston 64*u* via the retraction port 65*u* and an equal downward force on the balance piston 64*b* via the balance port 65*b*, thereby negating any net force.

Once the first threshold pressure differential has been achieved, continued pumping of the drilling fluid 29*d* may move the retractor, balance, and extender pistons 64*u,b*, 76*a-c*, the retraction and extension sleeves 63*u,b*, 75*a-c*, and the bypass sleeves 82*u,b* downward relative to the mandrel 56 and bypass body 81. The inner and outer slip joint sleeves 92, 93 may also be carried downward via the shearable fastener 95. The outer slip joint sleeve 92 may in turn carry the upper expander assembly 40*u* downward via the threaded connection with the upper end ring 41*u*. The lower expander assembly 40*b* may be held stationary via abutment against the liner shoe 34, thereby extending the expander 54 by forming the cone 42.

FIGS. 6A-6D illustrate opening of the bypass valve 80. Once the expander 54 has been shifted to the extended position, continued pumping of the drilling fluid 29*d* may increase pressure in the mandrel bore until a second threshold pressure differential is achieved sufficient to fracture the shearable fastener 95, thereby releasing the slip joint sleeves 92, 93 from the lower bypass sleeve 82*b*. Continued pumping of the drilling fluid 29*d* may continue to move the retractor, balance, and extender pistons 64*u,b*, 76*a-c*, the retraction and extension sleeves 63*u,b*, 75*a-c*, and the bypass sleeves 82*u,b* downward relative to the mandrel 56 and bypass body 81 until the strikers 83*a,b* engage the lock ring 90*k* and the enlarged annular space aligns with the lower bypass port 82*b*.

Continued pumping of the drilling fluid 29*d* may increase pressure in the mandrel bore until a third threshold pressure differential is achieved sufficient to fracture the shearable fastener 90*f*, thereby releasing the lock ring 90*k* from the mandrel 56. Continued pumping of the drilling fluid 29*d* may drive the lock ring 90*k* downward until the dog 90*d* is free to retract, thereby releasing the bore valve 78 from the bypass body 81. Continued pumping of the drilling fluid 29*d* may drive the bore valve 78 down the bypass body bore until the bore valve lands onto the shoulder 81*a*, thereby clearing the upper bypass port 88*u* and restoring circulation through the LDA 2*d*.

FIGS. 7A-7D illustrate cementing of the liner string 30. Once circulation through the LDA 2*d* has been restored, the cementing head 6 may be installed between the workstring 2 and the top drive 5 and conditioner 29*n* may be pumped down the workstring bore by the cement pump 16 via the cement line 22 (valve 25*c* open) and cementing head 6 to prepare for pumping of cement slurry 29*c*. Once the conditioner 29*n* as been circulated through the annulus 10*a*, the cement slurry 29*c* may be pumped from the mixer 26 into the cementing head 6 via the cement line 22 by the cement pump 16. The cement slurry 29*c* may flow into the workstring bore via the cementing head 6. Once the desired quantity of cement slurry 29*c* has been pumped, a gel plug 29*g* may be pumped from the mixer 26 and into the workstring bore via the via the cement line 22 and cementing head 6.

Once the gel plug 29*g* has been pumped, the chaser fluid 29*h* may be pumped into the cementing workstring bore via the cement line 22 and cementing head 6 by the cement pump 16. Pumping of the chaser fluid 29*h* by the cement pump 16 may continue until residual cement in the cement line 22 has been purged. Pumping of the chaser fluid 29*h* may then be transferred to the mud pump 17 by closing the valve 25*c* and opening the valve 25*m*. The gel plug 29*g* and cement slurry 29*s* may be driven through the workstring bore to the LDA 2*d* by the chaser fluid 29*h*. The cement slurry 29*c* may continue through the mandrel bore into the bypass body bore, and around the bore valve 78 via the open bypass ports 88*u,b*. The cement slurry 29*c* may flow through the open check valve 96 and the running body bore to the liner shoe 34. The cement slurry 29*c* may be discharged from the liner shoe 34 and into the annulus 10*a* via the open gate valve 34*v*. The cement slurry 29*c* may flow up the annulus 10*a* until a liner portion of the annulus 10*a* is filled therewith.

FIGS. 8A-8D illustrate release of the LDA 2*d* from the liner string 30. Once the cement slurry 29*c* has filled the liner portion of the annulus 10*a*, pumping of the chaser fluid 29*h* may be halted. The check valve 96 may close in response to halting of the pumping. The work stem 2*p*, mandrel 56, bypass body 81, and running body 95 may then be rotated 8*r* by operation of the top drive motor and raised by operation of the hoist 7, thereby closing the gate valve 34*v* and disengaging the running tool threaded coupling 95*t* from the liner shoe 34. As the workstring 2, mandrel 56, bypass body 81, and running body 95 are being raised, the second mandrel shoulder 56*b* may engage a lower face of the retractor piston 64*u*, thereby carrying the retractor, balance, and extender pistons 64*u,b*, 76*a-c* and the retraction and extension sleeves 63*u,b*, 75*a-c* therewith. The shoulder of the lower extension sleeve 75*c* may in turn engage the shoulder of the upper bypass sleeve 82*u*, thereby carrying the bypass sleeves 82*u,b* therewith.

FIGS. 9A-9D illustrate expansion of the liner string 30. Once the LDA 2*d* has been released from the liner string 30, rotation of the work stem 2*p* may be halted and pumping of the chaser fluid 29*h* may resume, thereby reopening the check valve 96 and pressurizing the expansion chamber 35 relative to the annulus 10*a*. The packoff cup seals 58 may be energized by the pressure differential of the expansion chamber 35 into further engagement with the liner inner surface and the pressure differential may exert an upward force on the packoff 50 and a downward force on the liner shoe 34. The liner string 30 may be constrained from downward movement by engagement with a bottom of the wellbore 10*w*. Pressure may be equalized across the extended expander 54 by the equalization port 87.

The upward force from the expansion chamber differential may push the packoff upward through the liner 32 while the hoist 7 is operated to raise the work stem 2*p*. Raising of the work stem 2*p* may in turn carry the mandrel 56, bypass body 81, and running body 95 upward. The running body lug 95*g* may engage the catch ring 94*h*, thereby carrying the base tube 95 and lower expander assembly 40*b* upward. The catch ring 94*h* may in turn engage the lower shoulder 93*b* of the inner slip joint sleeve 93 and the snap ring 91*f* may engage the latch groove 91*g* of the lower bypass sleeve 82*b*, thereby carrying the inner and outer slip joint sleeves 92, 93 and the bypass sleeves 82*u,b* upward. Upward movement of the lower expander assembly 40*b* may in turn carry the formed cone 42 upward through the liner 32, thereby plastically expanding the liner 32.

FIGS. 10A-10D illustrate pumping of the retractor tag 4*r* to the LDA 2*d*. As the expander 54 approaches an upper portion of the liner 32, the packoff 50 may exit the tieback head 31, thereby exposing the expansion chamber 35 to the annulus 10*a*. Expansion may continue by exerting tension on the workstring 2 via the hoist 7 and the liner string 30 may be constrained from upward movement by engagement of the lower expanded portion with the wellbore 10*w*. Expansion may be finished once the formed cone 42 expands the tieback head 31 and engages the head seals 31*s* with the tieback shoe 12*s*.

Once the formed cone 42 has exited the tieback head 31, the retractor tag launcher 28*r* may be operated and the chaser fluid 29*h* may propel the retractor tag 4*r* down the workstring 2 and to the antenna 71*r* of the retraction tool 51. The retractor tag 4*r* may transmit the command signal to the antenna 71*r* as the tag passes thereby.

FIGS. 11A-11D illustrate retraction of the expander 54. The retraction tool microcontroller may receive the command signal from the retractor tag 4*r* and may operate the toggle controller to energize the coil 73*c*, thereby driving the shaft 73*s* and connected flow tube 72*t* downward to disengage from the flapper 72*f*. The flapper 72*f* may close and continued pumping of the chaser fluid 29*h* may increase pressure in the retraction chamber (via retraction port 65*u*) relative to pressure in the balance chamber. The increased pressure may exert an upward force on the retractor piston 64*u*, thereby moving the retractor, balance, and extender pistons 64*u,b*, 76*a-c*, the retraction and extension sleeves 63*u,b*, 75*a-c*, and the bypass sleeves 82*u,b* upward relative to the mandrel 56 and bypass body 81. The inner and outer slip joint sleeves 92, 93 may also be carried upward via the engaged upper latch 91. The outer slip joint sleeve 92 may in turn carry the upper expander assembly 40*u* upward via the threaded connection with the upper end ring 41*u*, thereby retracting the expander 54 by disassembling the cone 42.

FIGS. 12A-12D illustrate sending an opener pulse 29*p* to the liner deployment assembly. Once the expander 54 has retracted, opener pressure pulses 29*p* may be transmitted down the workstring bore to the pressure sensor 66 by pumping against the closed flapper 72*f* and then relieving pressure in the workstring bore according to a protocol.

FIGS. 13A-13D illustrate circulation through the LDA 2*d*. The retractor microcontroller may receive the command signal from the pulses 29*p* and may operate the toggle controller to energize the coil 73*c*, thereby driving the shaft 73*s* and connected flow tube 72*t* upward to engage and open the flapper 72*f*. Chaser fluid 29*h* may be pumped down the workstring 2 and discharged through the running tool body 95 into the annulus upper portion to purge any excess cement slurry from the tieback shoe 12*s*. The workstring 2 may then be retrieved from the wellbore 10*w* to the rig 1*r*.

A mill string (not shown) may then be deployed into the wellbore 10*w* to a lower portion of the forming chamber 33. The mill string may be operated to mill through the forming chamber lower portion and the liner shoe 34. The mill string may then be retrieved from the wellbore 10*w* to the rig 1*r*. The drill string may then be deployed into the wellbore 10*w* and operated to drill through the intermediate formation 11*d* to the production zone.

Alternatively, the bypass valve 80 may be omitted, the bore valve 78 and holder 79 replaced with a valve and toggle similar to those of the actuator 62, and a pressure sensor may be added to the actuator 74 for sending a command signal to open the alternative valve using pressure pulses.

Alternatively, the toggle 73 and/or holder 79 may be hydraulic instead of electromagnetic. The alternative hydraulic toggle and/or holder may include an electric motor, a hydraulic pump, a hydraulic reservoir, a piston, and control valves for selectively operating the piston.

In a further variant to the hydraulic toggle 73 and/or holder 79, either or both of the respective valves 72, 78 thereof may be replaced by a three position flapper valve. The three position flapper valve may have an upwardly open position, a closed position, and a downwardly open position and three hydraulic couplings for hydraulic operation between the positions. The three position flapper valve is illustrated at FIGS. 21A, 21B, and 22A-C and discussed at paragraphs [00174]-[00187] of U.S. patent application Ser. No. 14/250,162 (Atty. Dock. No. WEAT/1129US), which is herein incorporated by reference in its entirety.

Alternatively, the command signals may be sent using radioactive tags, chemical tags (e.g., acidic or basic), distinct fluid tags (e.g., alcohol), wired drill pipe, or optical fiber drill pipe instead of or as a backup to the RFID tags and/or pressure pulses.

While the foregoing is directed to embodiments of the present disclosure, other and further embodiments of the disclosure may be devised without departing from the basic scope thereof, and the scope of the invention is determined by the claims that follow.

The invention claimed is:

1. A deployment assembly for expanding a liner string in a wellbore, comprising:

a tubular mandrel having a bore therethrough;

an expander linked to the mandrel and operable between an extended position and a retracted position;

an extension tool disposed along the mandrel and operable to extend the expander; and a retraction tool disposed along the mandrel and having:

an upper piston in fluid communication with the mandrel bore and operable to retract the expander;

a lower piston in fluid communication with the mandrel bore and operable to balance the upper piston;

a valve disposed between the pistons for isolating the lower piston from the upper piston in a closed position; and an electronics package linked to the valve for closing the valve in response to receiving a command signal.

2. The deployment assembly of claim 1, wherein:

the extension tool is located below the retraction tool, the extension tool is connected to the retraction tool, and the extension tool has an extender piston in fluid communication with the mandrel bore.

3. The deployment assembly of claim 2, wherein the extension tool further has:

a bore valve disposed below the extension piston; and an electronics package linked to the valve for closing the valve in response to receiving a command signal.

4. The deployment assembly of claim 3, wherein:

the extension tool further has a bypass valve having a body connected to the mandrel and a sleeve linked to the extension piston;

the extension tool further has a latch for fastening the bore valve to the bypass body, and the bypass valve further has a striker connected to the sleeve for releasing the latch after extension of the expander.

5. The deployment assembly of claim 2, further comprising a slip joint linking a lower portion of the expander to the mandrel and linking an upper portion of the expander to the extension tool.

6. The deployment assembly of claim 1, wherein the retraction tool further has:

an antenna extending along the mandrel bore for communication with a retractor tag pumped therethrough; and a pressure sensor in fluid communication with the mandrel bore for receiving a pressure pulse therefrom.

7. The deployment assembly of claim 1, wherein the valve has:

a flapper pivotally connected to the mandrel;

a spring biasing the flapper toward the closed position; and a flow tube longitudinally movable relative to the mandrel for propping the flapper open and allowing the spring to close the flapper.

8. The deployment assembly of claim 7, wherein the retraction tool further has an toggle in communication with the electronics package and connected to the flow tube for movement thereof.

9. The deployment assembly of claim 1, further comprising a packoff connected to the mandrel and having a seal for engaging an inner surface of the liner string.

10. The deployment assembly of claim 1, further comprising a running tool connected to the mandrel and having:

a body having a coupling for engagement with a shoe of the liner string; and a check valve for allowing downward flow through the mandrel bore and preventing upward flow through the mandrel bore.

11. The deployment assembly of claim 10, wherein the running tool further has a torque key for operating a gate valve of the liner shoe.

12. An expandable liner system, comprising:

the deployment assembly of claim 11; and a liner string, comprising:

a tieback head having a seal for engagement with a tieback shoe of a casing string;

one or more joints of expandable liner for connection to the tieback head;

a forming chamber for connection to the liner joints; and the shoe for connection to the forming chamber and having a latch receptacle for engagement with the running body coupling and the gate valve for operation by the torque key.

13. A method for expanding a liner string in a wellbore, comprising:

running a liner string into the wellbore using a workstring having a liner deployment assembly (LDA) releasably connected to the liner string;

after running the liner string, extending an expander of the LDA;

pressurizing an expansion chamber formed between the LDA and the liner string and raising the workstring, thereby driving the extended expander through the liner string;

sending a command signal to a retraction tool of the LDA, thereby closing a valve of the retraction tool and isolating a balance piston of the retraction tool from a retractor piston thereof; and pressurizing a bore of the workstring against the closed valve to operate the retractor piston, thereby retracting the expander.

14. The method of claim 13, wherein the expander is extended by:

sending another command signal to an extension tool of the LDA, thereby closing a bore valve thereof; and after sending the first command signal, pressurizing the workstring bore against the closed bore valve to operate a piston of the extension tool.

15. The method of claim 13, wherein the command signal to close the bore valve is sent by pumping a tag through the workstring.

16. The method of claim 13, further comprising releasing the LDA from the liner string, thereby also closing a gate valve of the liner string.

17. The method of claim 16, further comprising wherein the LDA is released from the liner string by rotating the workstring.

18. The method of claim 13, wherein:

the method further comprises pumping cement slurry through the workstring and into an annulus formed between the liner string and the wellbore, and the cement slurry is pumped after extending the expander and before pressurizing the expansion chamber.

19. The method of claim 18, further comprising:

after retracting the expander, sending another command signal to the retraction tool, thereby opening the valve; and after opening the valve, circulating fluid through the LDA.

20. The method of claim 19, wherein:

the command signal to close the valve is sent by pumping a tag through the workstring, and the command signal to open the valve is sent by pulsing pressure against the closed valve.

21. The method of claim 13, wherein a tieback head of the liner string is expanded into engagement with a tieback shoe of a casing string during driving of the extended expander.

22. The method of claim 13, wherein a monobore is formed through the casing string and liner string after the extended expander is driven through the liner string.

* * * * *